US011457790B2

(12) United States Patent
Braendle et al.

(10) Patent No.: US 11,457,790 B2
(45) Date of Patent: Oct. 4, 2022

(54) FLOOR CLEANING MACHINE

(71) Applicant: Alfred Kärcher SE & Co. KG, Winnenden (DE)

(72) Inventors: Alexander Braendle, Gundelsheim (DE); Manuel Schulze, Kornwestheim (DE); Fabian Moser, Schorndorf (DE); Moritz Irion, Cologne (DE); Swen Sorgenfrei, Schwaikheim (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 106 days.

(21) Appl. No.: 17/005,043

(22) Filed: Aug. 27, 2020

(65) Prior Publication Data

US 2020/0390310 A1 Dec. 17, 2020

Related U.S. Application Data

(63) Continuation of application No. 15/985,105, filed on May 21, 2018, now Pat. No. 10,786,130, which is a continuation of application No. 15/179,458, filed on Jun. 10, 2016, now Pat. No. 9,999,332, which is a (Continued)

(51) Int. Cl.

| | |
|---|---|
| ***A47L 11/26*** | (2006.01) |
| ***A47L 11/204*** | (2006.01) |
| ***A47L 11/40*** | (2006.01) |
| ***A47L 5/24*** | (2006.01) |
| ***A47L 9/32*** | (2006.01) |

(52) U.S. Cl.

CPC ..... *A47L 11/26* (2013.01); *A47L 5/24* (2013.01); *A47L 9/322* (2013.01); *A47L 11/204* (2013.01); *A47L 11/4016* (2013.01); *A47L 11/4041* (2013.01); *A47L 11/4044* (2013.01); *A47L 11/4083* (2013.01)

(58) Field of Classification Search

CPC . A47L 11/26; A47L 5/24; A47L 9/322; A47L 11/204; A47L 11/4016; A47L 11/4041; A47L 11/4044; A47L 11/4083

See application file for complete search history.

(56) References Cited

U.S. PATENT DOCUMENTS

| | | | |
|---|---|---|---|
| 1,436,420 | A | 11/1922 | Weydell |
| 4,136,420 | A | 1/1979 | Cyphert et al. |
| 4,173,054 | A | 11/1979 | Ando |

(Continued)

FOREIGN PATENT DOCUMENTS

| | | |
|---|---|---|
| CA | 2 411 936 | 11/2003 |
| CH | 607 578 | 9/1978 |

(Continued)

*Primary Examiner* — Andrew A Horton

(74) *Attorney, Agent, or Firm* — Womble Bond Dickinson (US) LLP

(57) ABSTRACT

A floor cleaning machine is provided, in particular a hand-guided and/or hand-held floor cleaning machine, including a support device, at least one cleaning roller arranged on the support device, capable of being driven in rotation and provided with a cleaning substrate, said cleaning substrate being made of a textile material; and at least one mouth towards the at least one cleaning roller that includes a first and a spaced second mouth wall having a mouth opening therebetween, wherein the first mouth wall is positioned above the second mouth wall relative to the direction of gravity, wherein the first and/or second mouth wall protrude(s) into the cleaning substrate of the at least one cleaning roller.

20 Claims, 15 Drawing Sheets

Related U.S. Application Data continuation of application No. PCT/EP2013/076445, filed on Dec. 12, 2013.

(56) References Cited

U.S. PATENT DOCUMENTS

| | | | |
|---|---|---|---|
| 4,668,256 | A | 5/1987 | Billiet et al. |
| 4,908,898 | A | 3/1990 | Kubo |
| 5,086,539 | A | 2/1992 | Rench |
| 5,350,432 | A | 9/1994 | Lee |
| 5,657,504 | A | 8/1997 | Khoury |
| 6,026,529 | A | 2/2000 | Caruso |
| 6,266,838 | B1 | 7/2001 | Caruso |
| 6,400,048 | B1 | 6/2002 | Nishimura et al. |
| 6,475,256 | B2 | 11/2002 | Matsubara et al. |
| 6,662,402 | B2 | 12/2003 | Giddings et al. |
| 6,735,812 | B2 | 5/2004 | Hekman et al. |
| 7,022,003 | B1 | 4/2006 | Hughes |
| 7,128,770 | B2 | 10/2006 | Oh et al. |
| 7,150,068 | B1 | 12/2006 | Ragner |
| 7,272,870 | B2 | 9/2007 | Pierce et al. |
| 7,341,611 | B2 | 3/2008 | Greene et al. |
| 7,559,963 | B2 | 7/2009 | Oh et al. |
| 7,665,174 | B2 | 2/2010 | Basham et al. |
| 7,921,497 | B2 | 4/2011 | Cook et al. |
| 7,967,914 | B2 | 6/2011 | Giddings et al. |
| 7,979,952 | B2 | 7/2011 | Beskow et al. |
| 8,016,996 | B2 | 9/2011 | Field et al. |
| 8,025,786 | B2 | 9/2011 | Field et al. |
| 8,230,549 | B2 | 7/2012 | Lenkiewicz et al. |
| 9,289,105 | B2 | 3/2016 | Moes |
| 9,999,332 | B2 | 6/2018 | Braendle et al. |
| 2002/0194692 | A1 | 12/2002 | Giddings et al. |
| 2003/0159232 | A1 | 8/2003 | Hekman et al. |
| 2005/0160553 | A1 | 7/2005 | Gregory |
| 2005/0262659 | A1 | 12/2005 | Roschi et al. |
| 2006/0123587 | A1 | 6/2006 | Parr et al. |
| 2006/0236494 | A1 | 10/2006 | Nelson et al. |
| 2009/0089967 | A1 | 4/2009 | Yang et al. |
| 2009/0119871 | A1 | 5/2009 | Dilger et al. |
| 2009/0229069 | A1 | 9/2009 | Lenkiewicz et al. |
| 2010/0132150 | A1 | 6/2010 | Egler et al. |
| 2010/0236010 | A1 | 9/2010 | Johnson |
| 2012/0066861 | A1 | 3/2012 | Louis et al. |
| 2012/0222244 | A1 | 9/2012 | Conrad |
| 2013/0091663 | A1 | 4/2013 | Mersmann |
| 2013/0219641 | A1 | 8/2013 | Guijarro |
| 2014/0000060 | A1 | 1/2014 | Demirtas et al. |
| 2014/0150984 | A1 | 6/2014 | Nishikawa et al. |
| 2014/0182079 | A1 | 7/2014 | Van Der Kooi et al. |
| 2015/0082579 | A1 | 3/2015 | Lin |
| 2016/0270613 | A1 | 9/2016 | Demirtas et al. |
| 2016/0278597 | A1 | 9/2016 | Braendle et al. |
| 2017/0215676 | A1 | 8/2017 | Moser et al. |
| 2017/0215677 | A1 | 8/2017 | Moser et al. |
| 2017/0215678 | A1 | 8/2017 | Moser et al. |
| 2017/0215679 | A1 | 8/2017 | Moser et al. |
| 2017/0215681 | A1 | 8/2017 | Moser et al. |
| 2018/0228331 | A1 | 8/2018 | Moser et al. |
| 2018/0249877 | A1 | 9/2018 | Blum et al. |

FOREIGN PATENT DOCUMENTS

| | | |
|---|---|---|
| CN | 2109165 | 7/1992 |
| CN | 2174947 | 8/1994 |
| CN | 2266377 | 11/1997 |
| CN | 2659322 | 12/2004 |
| CN | 2675734 | 2/2005 |
| CN | 1718149 | 1/2006 |
| CN | 2845698 Y | 12/2006 |
| CN | 201158807 | 12/2008 |
| CN | 201384462 | 1/2010 |
| CN | 201814516 | 5/2011 |
| CN | 201930938 | 8/2011 |
| CN | 202151938 | 2/2012 |
| CN | 102493381 | 6/2012 |
| CN | 202313126 | 7/2012 |
| CN | 203346836 | 12/2013 |
| CN | 103690112 | 4/2014 |
| DE | 294 642 | 10/1991 |
| DE | 41 17 957 | 12/1992 |
| DE | 102 42 257 | 4/2003 |
| DE | 10 2004 013 262 | 9/2005 |
| DE | 10 2007 031 371 | 1/2009 |
| DE | 10 2008 013 485 | 11/2009 |
| EP | 0 012 337 | 6/1980 |
| EP | 0 186 005 | 7/1986 |
| EP | 0 844 843 | 7/2002 |
| EP | 1 535 560 | 1/2005 |
| EP | 1 465 518 | 4/2005 |
| EP | 1 736 089 | 12/2006 |
| EP | 1994868 | 11/2008 |
| EP | 2 177 128 | 4/2010 |
| EP | 2 229 863 | 9/2010 |
| EP | 2 343 003 | 7/2011 |
| EP | 2 387 932 | 11/2011 |
| EP | 2 641 524 | 9/2013 |
| EP | 2 721 988 | 4/2014 |
| FR | 2 797 895 | 3/2001 |
| GB | 1123052 | 8/1968 |
| GB | 2 341 124 | 3/2000 |
| GB | 2 411 823 | 9/2005 |
| GB | 2 420 967 | 6/2006 |
| GB | 2 435 820 | 9/2007 |
| GB | 2 493 146 | 1/2013 |
| JP | 2000342495 | 12/2000 |
| JP | 2001037695 | 2/2001 |
| JP | 2005-211350 | 8/2005 |
| JP | 2013081829 | 5/2013 |
| WO | WO 84/04663 | 12/1984 |
| WO | WO 90/14787 | 12/1990 |
| WO | WO 97/06721 | 2/1997 |
| WO | WO 00/78198 | 12/2000 |
| WO | WO 01/037716 | 5/2001 |
| WO | WO 02/28251 | 4/2002 |
| WO | WO 02/069775 | 9/2002 |
| WO | WO 2005/089614 | 9/2005 |
| WO | WO 2005/096907 | 10/2005 |
| WO | WO 2006/102147 | 9/2006 |
| WO | WO 2006/110459 | 10/2006 |
| WO | WO 2010/041185 | 4/2010 |
| WO | WO 2010/140967 | 12/2010 |
| WO | WO 2013/027140 | 2/2013 |
| WO | WO 2013/027164 | 2/2013 |
| WO | WO 2013/106762 | 7/2013 |

FIG. 5 (b)
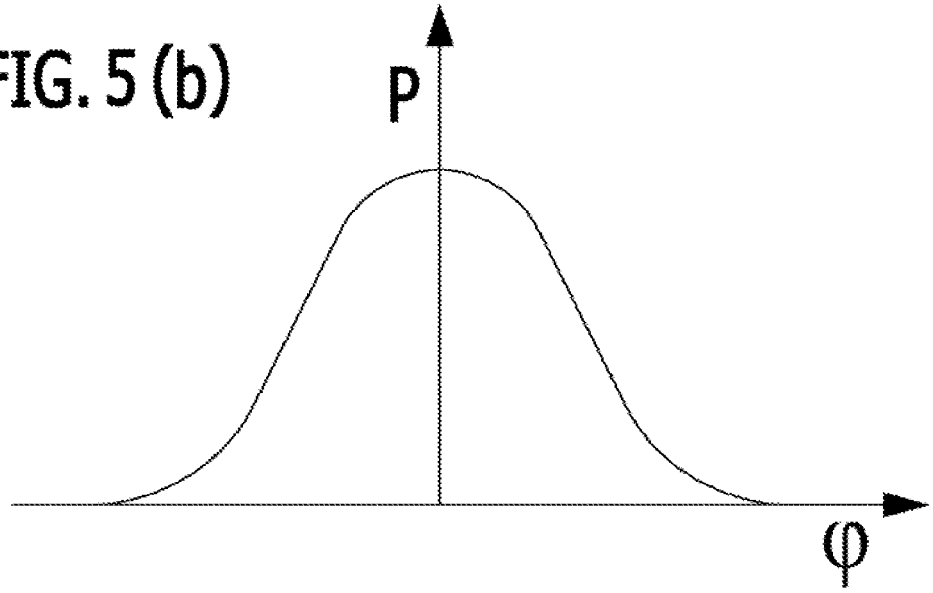
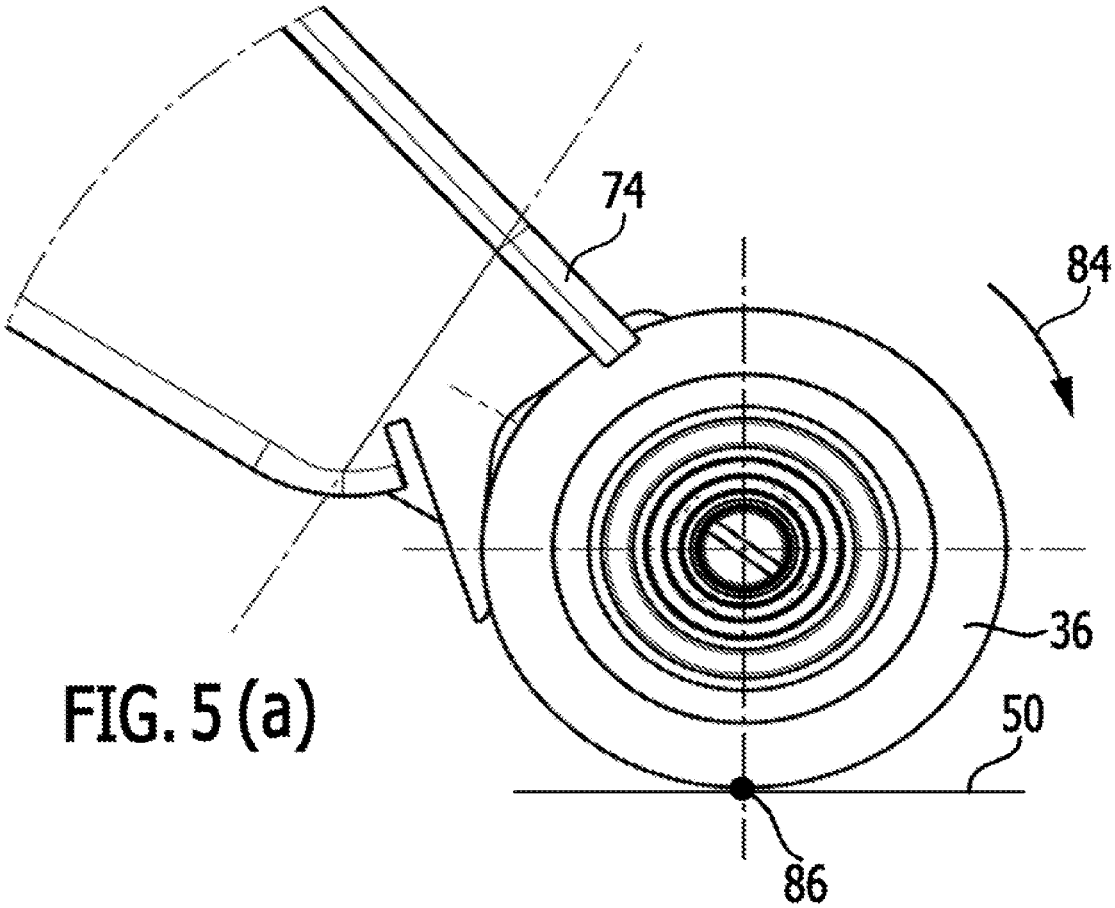
FIG. 5 (a)

FLOOR CLEANING MACHINE

CROSS-REFERENCE TO RELATED APPLICATIONS

This application is a continuation of U.S. application Ser. No. 15/985,105, filed May 21, 2018, which is a continuation of U.S. application Ser. No. 15/179,458, filed Jun. 10, 2016, which is a continuation of international application number PCT/EP2013/076445 filed on Dec. 12, 2013, which are incorporated herein by reference in their entireties and for all purposes.

BACKGROUND OF THE INVENTION

The invention relates to a floor cleaning machine, in particular a hand-guided and/or hand-held floor cleaning machine, comprising a support device, at least one cleaning roller which is arranged on the support device, is capable of being driven in rotation and is provided with a cleaning substrate, a fan device for creating a suction flow, and a suction channel device for the suction flow which provides at least one suction channel operatively connected for fluid communication between the fan device and the at least one cleaning roller, wherein the at least one suction channel has at least one mouth towards the at least one cleaning roller and wherein the at least one mouth comprises a first mouth wall and a spaced second mouth wall having a mouth opening formed therebetween, wherein the first mouth wall is positioned above the second mouth wall relative to the direction of gravity when the at least one cleaning roller is placed on a floor that is to be cleaned.

WO 2010/140967 A1 discloses an arrangement for cleaning of a soiled surface.

EP 2 177 128 A1 discloses a brush assembly for a floor cleaning device.

FR 2 797 895 A1 discloses a cylindrical brush.

US 2002/0194692 A1 discloses a floor cleaning machine comprising a dispenser for cleaning liquid.

CH 607 578 discloses a brush device capable of being connected to a water conduit, wherein a perforated hollow axle which can have water supplied thereto has mounted thereon a brush roller that is permeable to water in the shell area thereof.

DE 41 17 957 A1 discloses an apparatus for treating a surface, said apparatus comprising a wiping device having a cloth-like wiper element capable of being passed across the surface that is to be cleaned, a wetting device for wetting the wiper element and a suction device for suctioning the wiper element.

SUMMARY OF THE INVENTION

In accordance with an embodiment of the invention, a floor cleaning machine is provided that achieves an optimized cleaning result while being easy to use.

In accordance with an embodiment of the invention, the floor cleaning machine is configured such that the first mouth wall and/or the second mouth wall are/is in contact against or protrude(s) into the cleaning substrate of the at least one cleaning roller.

By having at least one mouth wall in contact against or protruding (i.e. extending) into the cleaning substrate of the at least one cleaning roller, it is possible to achieve an optimized suction result. The at least one cleaning roller is moved past the at least one mouth where a negative pressure is applied, i.e. where a suction flow is created, and dirt can be sucked in.

In particular, an end face of the first mouth wall and/or an end face of the second mouth wall are/is at least approximately parallel to an axis of rotation of the at least one cleaning roller. This results in an effective suction action. It is possible to realize a wipe function while suctioning.

In principle, the first mouth wall can be in contact against the cleaning substrate or protrude thereinto and the second mouth wall can be in contact against the cleaning substrate of the at least one cleaning roller or be spaced therefrom or protrude thereinto, or, if the second mouth wall is in contact against the cleaning substrate or protrudes thereinto, the first mouth wall can be in contact against the cleaning substrate or protrude thereinto or be spaced therefrom. In particular, the first mouth wall is in contact against or protrudes into the cleaning substrate and a direction of rotation of the at least one cleaning roller is such that a certain point on the at least one cleaning roller is first moved past the second mouth wall and then past the first mouth wall. If the second mouth wall is in contact against or protrudes into the cleaning substrate, a direction of rotation is in particular such that a certain point on the at least one cleaning roller is first moved past the first mouth wall and then past the second mouth wall.

In an exemplary embodiment, the mouth has arranged thereat a contact element which is in contact against or protrudes into the cleaning substrate and projects transversely away from the first mouth wall or the second mouth wall, wherein a fluid seal is present between the contact element and the corresponding mouth wall. The contact element provides increased surface area which is in contact against or protrudes into the cleaning substrate and permits enhanced fluid-tightness to be achieved which in turn enhances the suction action. The contact element forms (in cross-section) a kind of beak that projects away from the first mouth wall or the second mouth wall. When rotating, the at least one cleaning roller is moved past the contact element.

In an exemplary embodiment, the contact element is located at the first mouth wall. This provides a simple way of achieving an enhanced suction effect. Fluid-tightness between the contact element and the mouth can be realized in a simple manner.

It is advantageous for the contact element to have, on a side thereof facing towards the at least one cleaning roller, a curved contour which is adapted to the at least one cleaning roller. In particular, the contour has a circular contour that is adapted to a corresponding circular contour of the at least one cleaning roller at least in relation to an envelope. The frictional resistance that is developed by rotating the at least one cleaning roller past the contact element is thereby minimized.

The contact element has a first end which is spaced from the mouth and has a second end which is positioned at the mouth, wherein it is advantageous for the contact element to be configured such that a resultant negative pressure is less at the first end thereof than at the second end thereof. As a result, the risk of "fluid short-circuiting" by which fluid and in particular liquid could be pulled out in the area of the first end is reduced. This enhances the cleaning result.

By way of example, a configuration for reducing the resultant negative pressure at the first end compared with the second end can be such that the contact element is made sufficiently long, with this then providing for an increased frictional surface. In an exemplary embodiment, the contact element has a first area comprising the first end and has a second area comprising the second end, wherein a distance of the contact element from an axis of rotation of the at least one cleaning roller is larger at the first area than at the second area. It is thereby possible for the resultant negative pressure to be reduced in the area of the first end compared with the area of the second end, and the risk of fluid short-circuiting is reduced. This configuration can be easily achieved by a corresponding surface configuration of the contact element on the side thereof that faces towards the at least one cleaning roller. As an example, the contact element has a stepped configuration at the corresponding surface thereof, in particular wherein the step follows a smooth course (with no sharp corners).

It is advantageous for the second mouth wall to be arranged at a position upstream of the first mouth wall with respect to a direction of rotation of the at least one cleaning roller. With this arrangement, a certain area on the cleaning roller is first moved past the second mouth wall and then past the first mouth wall upon rotation of the cleaning roller. This results in effective suction with ease of use. The present exemplary embodiment provides a short path for delivering dirt particles adhering to the cleaning substrate to the mouth. Furthermore, this direction of rotation is advantageous when the corresponding floor cleaning machine is worked cleaning towards an exit of the space being cleaned.

In an exemplary embodiment, a distance of an end face of the first mouth wall from an axis of rotation of the at least one cleaning roller is less than a distance of an end face of the second mouth wall from said axis of rotation.

It is advantageous for the mouth opening of the at least one mouth to be at least approximately rectangular in cross-section. This allows the cleaning roller to be suctioned from the outside over a large area thereof, and this results in effective dirt suctioning.

It is then correspondingly advantageous for the at least one suction channel to have a configuration that tapers towards a separator device. A kind of funnel is thereby arranged at the suction channel in order to enable effective dirt suctioning from the cleaning roller. A large cross-sectional area can be provided at the mouth and in the further course of the at least one suction channel to the tapering, and this is advantageous in terms of fluid flow. By way of the taper in the vicinity of the separator device, the velocity of flow can be increased.

It is advantageous for at least one cleaning liquid container to be provided, said cleaning liquid container being operatively connected for fluid communication with the at least one cleaning roller, in particular wherein the at least one cleaning roller is provided with cleaning liquid via an interior space of the at least one cleaning roller. It is thereby possible for the cleaning roller and in particular the cleaning substrate thereof to be wetted (moistened) and for a wiping function to be realized with the floor cleaning machine. The corresponding cleaning liquid is provided via the cleaning liquid container. In particular, the cleaning liquid container is removably arranged on the floor cleaning machine.

In an exemplary embodiment, the at least one cleaning liquid container is arranged on a user holding unit. It is thereby possible for the cleaning liquid container to be positioned on the floor cleaning machine in an effective manner, thereby positioning the cleaning liquid container above the at least one cleaning roller with respect to the direction of gravity.

It is advantageous for the fan device to be arranged on the support device and/or for the suction channel device to be arranged on the support device. This makes for a construction that is simple in structure.

In an exemplary embodiment, the suction channel device comprises a housing in which the at least one suction channel is arranged or formed. For example, the housing may be used to accommodate a dirty liquid container and/or a separator device. It may also be used to house, for example, a battery device and in particular a rechargeable battery device.

It is advantageous for an elastic device to be provided by way of which the suction channel device is elastically urged against the at least one cleaning roller, in particular wherein the elastic device is or comprises a spring device. This provides a simple way of having the first and/or the second mouth wall in contact against or driven into the cleaning substrate of the at least one cleaning roller. The corresponding functionality is also ensured during wear of the cleaning substrate, at least until a certain threshold is reached.

In an exemplary embodiment, the elastic device has a first side thereof supported on the support device. The support device then forms a mounting face for the elastic device.

It is also possible for the elastic device to have a first side thereof supported on the fan device or on a separator device. The fan device or the separator device then forms a mounting face for the elastic device.

In an exemplary embodiment, the elastic device has a second side thereof supported on the suction channel device. A corresponding biasing force is thereby exerted on the suction channel device directly, whereby the suction channel device has its first mouth wall urged against the cleaning substrate.

It is also possible for the elastic device to have a second side thereof supported on the fan device or on the separator device, wherein the fan device or the separator device is connected to the suction channel device, wherein said connection is a direct connection or a force-locking connection. Thus, the suction channel device is then urged against the cleaning substrate via the fan device or the separator device by a direct engagement or a force-locking engagement therewith.

It is advantageous for a dirty liquid container to be provided, said dirty liquid container being associated with a separator device. Dirty cleaning liquid can thereby be collected. A separator device separates air from liquid and solid constituents in a suction flow.

It is advantageous for the dirty liquid container to be arranged at the suction channel device. This makes for a compact construction and enables flow paths to be minimized.

It is further advantageous for the support device to have arranged thereon a user holding unit which is in particular arranged for pivotal movement about a joint. This then enables a user to operate the floor cleaning machine easily and also, for example, with one hand. The user may push or pull the floor cleaning machine, thereby covering a large surface area with minimal relocating.

For example, a pivot axis of the joint is parallel to an axis of rotation of the at least one cleaning roller. The result is ease of use.

In an exemplary embodiment, the user holding unit comprises a stick device comprising for example a stick on which a handle is located. This configuration makes for a compact construction combined with ease of use.

It is advantageous if, in a cleaning process, the floor cleaning machine is supported on the floor via the at least one cleaning roller alone and is in particular characterized by being configured in a manner that is free of supporting wheels. This makes for a compact construction. The entire weight of the floor cleaning machine can be supported via the at least one cleaning roller. By configuring the machine to have no supporting wheels, the problem of abrasion marking on the floor to be cleaned is prevented.

It is advantageous for a direction of rotation of the at least one cleaning roller to be from a line of contact with the floor to be cleaned towards the second mouth wall and then towards the first mouth wall and, in particular, for the direction of rotation to be clockwise when the at least one cleaning roller is placed on the floor. This allows effective operation of the floor cleaning machine when working out of a space that is being cleaned.

It is particularly advantageous for the at least one cleaning roller to be provided with grooves for generating pulses of air in a suction flow. By way of grooves and in particular grooves in spaced-apart relation which are rotated through the mouth where the suction flow is present, short pulses of air can be generated. These allow dirt adhered to the cleaning substrate, and in particular to the textile cleaning substrate, of the cleaning roller to be entrained therewith. An effective cleaning effect can thereby be achieved.

In particular, a groove is formed by an area that is free of cleaning substrate or reduced in cleaning substrate in order to enable corresponding pulses of air to be created in the suction flow. In principle, a groove may take any desired shape, such as the shape of a slot or the shape of a cylinder.

In particular, a plurality of spaced-apart grooves are provided, these being spaced apart in an axial direction of the at least one cleaning roller and in a circumferential direction of the at least one cleaning roller. By appropriate arrangement of the grooves, dead spots on the at least one cleaning roller can be prevented and effective entrainment of adherent dirt particles can be realized over substantially the entire effective surface area of the at least one cleaning roller. By way of example, a groove can have a rectangular cross-section or a circular cross-section. Groove forms different than that are also possible.

By way of example, a groove (in particular when of rectangular cross-section) has a length that is no more than 10% of an axial length of the at least one cleaning roller.

Furthermore, it is for example advantageous for a groove (in particular when of rectangular cross-section) to have a width that is no more than 5% of a circumferential length of the at least one cleaning roller.

In an exemplary embodiment, at least one sweeping lip is arranged at the suction channel device. Via the at least one sweeping lip, it is possible to realize a sweeping function in addition to the wiping function of the floor cleaning machine. For example, by arranging the at least one sweeping lip at the suction channel device, coarse dirt on the floor that the wiping function of the at least one cleaning roller cannot directly capture can be picked by the at least one cleaning roller in an area that is formed intermediate the at least one sweeping lip and the at least one cleaning roller and can be delivered to the mouth with suction flow.

In particular, the at least one sweeping lip is then arranged and configured such that coarse dirt between the at least one sweeping lip and the at least one cleaning roller is picked up by the at least one cleaning roller and delivered to the at least one mouth. In this way, coarse dirt can additionally be sucked up.

Advantageously, the at least one sweeping lip isolates a space behind the at least one cleaning roller and below the suction channel device towards the floor to be cleaned from the at least one cleaning roller when the at least one cleaning roller is placed on the floor. It is thereby possible to realize a sweep function and pick up and carry away coarse dirt.

It is advantageous for the at least one sweeping lip to be movably arranged and/or to be movably configured and, in particular, to be elastically configured. It is thereby possible for the at least one sweeping lip to be placed against the floor to be cleaned in an effective manner in order to effect coarse-dirt pickup.

It is particularly advantageous for a supplementary air device to be provided by way of which a supply of supplementary air is provided to the at least one cleaning roller. In particular in the presence of a sweeping lip, the suction power may no longer be sufficient by lack of air supply to the mouth. By way of the supplementary air device, it is ensured that there is a sufficient supplementary air supply to accomplish effective suction even when the sweeping lip is present.

The supplementary air device comprises at least one channel having an outlet-side mouth for supplementary air that is oriented towards the at least one cleaning roller, in particular wherein the at least one channel for supplementary air is arranged or formed at the suction channel device. In this way, the mouth for suction flow has supplementary air supplied thereto in a relatively direct manner in order to afford effective suction.

In particular, the at least one outlet-side mouth for supplementary air is arranged between the at least one mouth for suction flow and the at least one sweeping lip. This results in an effective suction action even while performing a sweep function.

Further, it is advantageous for the at least one channel to have at least one inlet-side mouth for supplementary air via which supplementary air is capable of being coupled in. Said supplementary air is for example air taken from the surroundings or is process exhaust air or is exhaust air derived from the fan device.

In an exemplary embodiment, the at least one inlet-side mouth is arranged on an underside of the suction channel device and is in particular arranged at or near an end of the suction channel device that is associated with the at least one cleaning roller. Supplementary air supply can thereby be achieved using simple structure.

In a further exemplary embodiment, the at least one channel is routed along the suction channel device. By way of example, this enables supplementary air to be provided from the fan device.

In particular, the at least one channel is then routed to the fan device. For example, exhaust air of the fan device or cooling air of the fan device can then be utilized as a source of supplementary air.

The following description of preferred embodiments serves in conjunction with the drawings to explain the invention in greater detail.

BRIEF DESCRIPTION OF THE DRAWINGS

FIG. 5(*a*) is an enlarged representation of a portion of the cleaning roller in accordance with FIG. 3;

FIG. 5(*b*) is a schematic representation of a contact pressure exerted by the cleaning roller on a floor to be cleaned depending on a rotational angle;

DETAILED DESCRIPTION OF THE INVENTION

Figure 1:
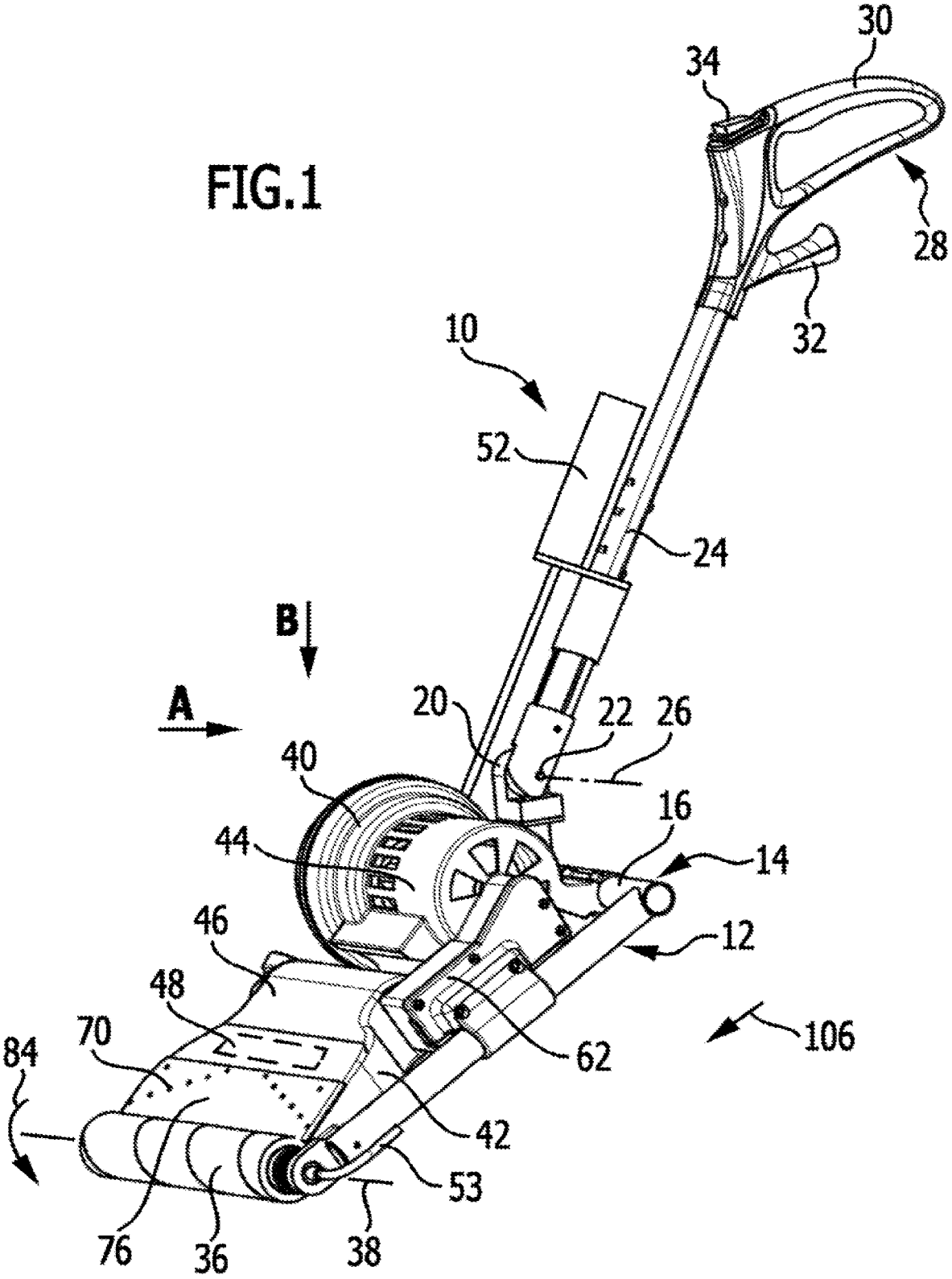
FIG. 1 is a perspective view of an exemplary embodiment of a floor cleaning machine constructed in accordance with the invention.
Figure 2:
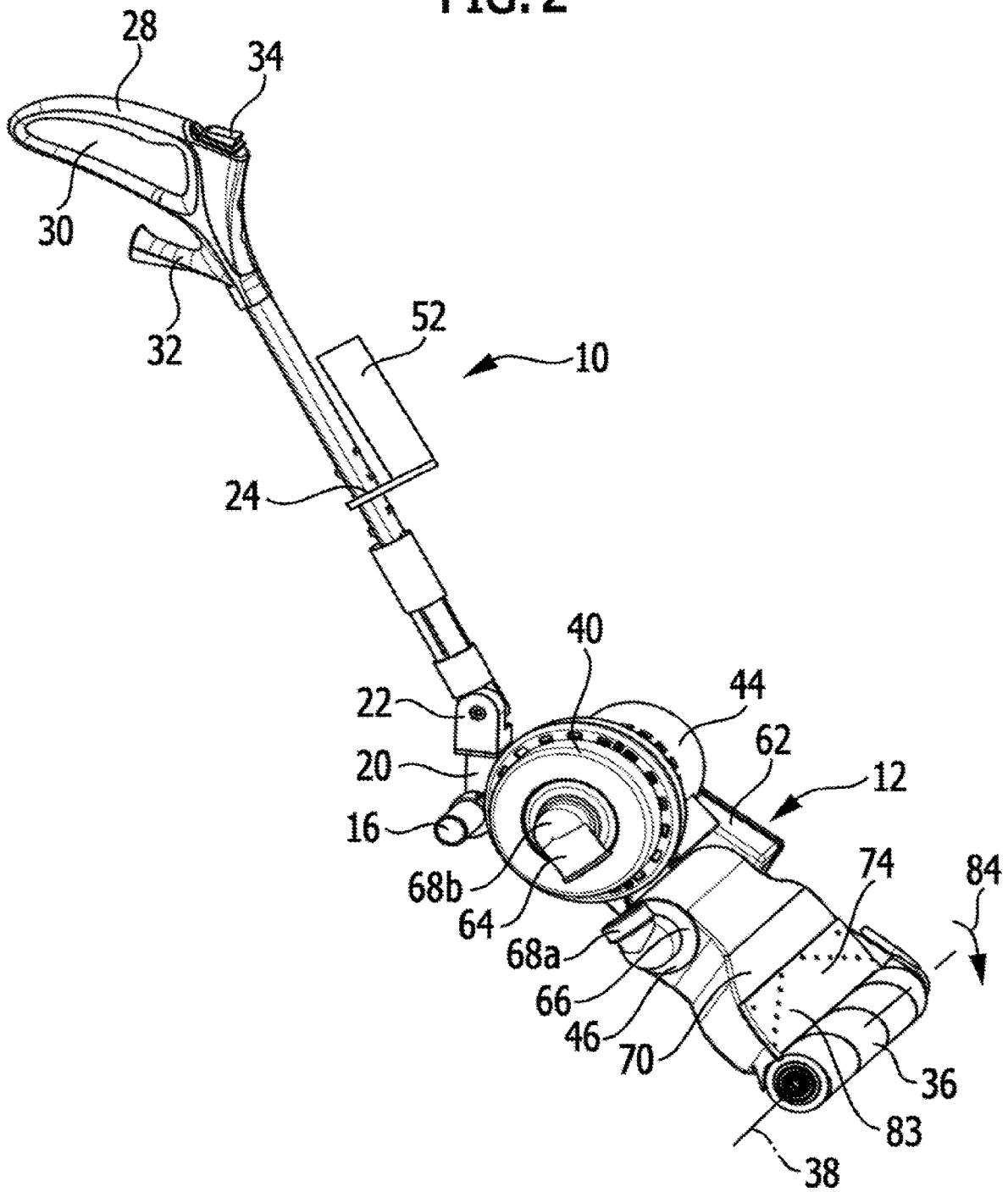
FIG. 2 is another perspective view of the floor cleaning machine in accordance with FIG. 1.

An exemplary embodiment of a floor cleaning machine, shown in overall view in FIGS. 1 and 2 and designated therein by 10, is a hand-guided and hand-held floor cleaning machine. This comprises a support device 12. The support device 12 is configured in the form of a frame 14.

Said frame 14 comprises a first frame bar 16 and a second frame bar 18. The second frame bar 18 is oriented transversely and in particular perpendicularly relative to the first frame bar 16 and is fixed to the first frame bar 16.

The first frame bar 16 and the second frame bar 18 span a plane. Located at the first frame bar 16 is an element 20 that protrudes beyond said plane. Held on the element 20 is a joint 22, and located at the joint 22 is a stick device 24. In the exemplary embodiment shown, the stick device 24 comprises a single stick.

The stick device 24 is held on the support device 12 for pivotal movement about a pivot axis 26 via the joint 22. The pivot axis 26 is at least approximately parallel to the first frame bar 16.

A handle 28 is located at an end of the stick device 24 that is opposite that via which the stick device 24 is fixed to the joint 22. In an exemplary embodiment, the handle 28 comprises a closed loop 30. It further comprises a grip element 32 in spaced relation to the loop 30.

Located at the handle 28 is or are one or more switches 34 for switching on and off a cleaning operation of the floor cleaning machine 10.

The stick device 24 including the handle 28 forms a user holding device via which a user can hold and guide the floor cleaning machine 10. The stick device 24 has a length such that a user can guide and operate the floor cleaning machine 10 which is placed on the floor to be cleaned in a standing posture without having to stoop.

In an exemplary embodiment, the stick device 24 is configured such that the length thereof and in particular the distance between the handle 28 and the joint 22 is fixably adjustable. This enables adjustment to different users.

Located at the second frame bar 18, in the area of a front end of the support device 12, is a cleaning roller 36. The cleaning roller 36 is capable of being driven in rotation about an axis of rotation 38. To this end, for example, a drive is provided which is positioned in an interior space of the cleaning roller 36.

The axis of rotation 38 is in particular parallel to the pivot axis 26.

Furthermore, a fan device 40 is located at the support device 12. The fan device 40 creates a suction flow. A suction channel device 42 is arranged at the support device 12, between the fan device 40 and the cleaning roller 36. The suction channel device 42 provides an operative connection for fluidly communicating the cleaning roller 36 and the fan device 40 in order to allow the suction flow induced by the fan device 40 to be conducted away from the cleaning roller 36.

The fan device 40 has associated with it a drive 44 and in particular an electromotive drive 44. This drive is likewise positioned at the support device 12.

The fan device 40 has associated with it a separator device 46 by which an air portion and a remaining portion (liquid containing dirt particles) are capable of being separated in the suction flow. The separator device 46 is arranged upstream of the fan device 40 in the suction flow. It is in particular positioned at the suction channel device 42.

The separator device 46 in turn has associated with it a dirty liquid container 48 in which dirt-bearing liquid can be received. The dirty liquid container 48 is in particular removably arranged at the support device 12 and in particular at the suction channel device 42 so that it can be easily emptied and/or cleaned.

For performing a cleaning operation on a floor 50, the cleaning roller 36 is wetted (moistened). The floor cleaning machine 10 comprises a cleaning liquid container 52. In an exemplary embodiment, the cleaning liquid container 52 is arranged on the stick device 24 and is in particular removably arranged thereon for refilling. One or more liquid conduits 53 run from the cleaning liquid container 52 to the cleaning roller 36.

The suction channel device 42 is the "communicating" unit between the fan device 40 and the cleaning roller 36. It has the suction flow passed therethrough in order for a separation process to be effected in the separator device 46, thereby separating an air portion from a remaining portion. In principle, the suction flow contains air as a "carrier medium", wherein the corresponding negative pressure flow is created by the fan device 40, as well as a liquid portion and a solids portion. The cleaning roller 36 is wetted by cleaning liquid (in particular water which may contain additives) from the cleaning liquid container 52 as will be explained in more detail below. Cleaning liquid can thereby be applied to the floor 50 that is to be cleaned, and dirt adhering to the floor can be softened up. Liquid and dissolved dirt or non-dissolved dirt particles are sucked in and conveyed through the suction channel device 42 into the separator device 46.

Figure 9:
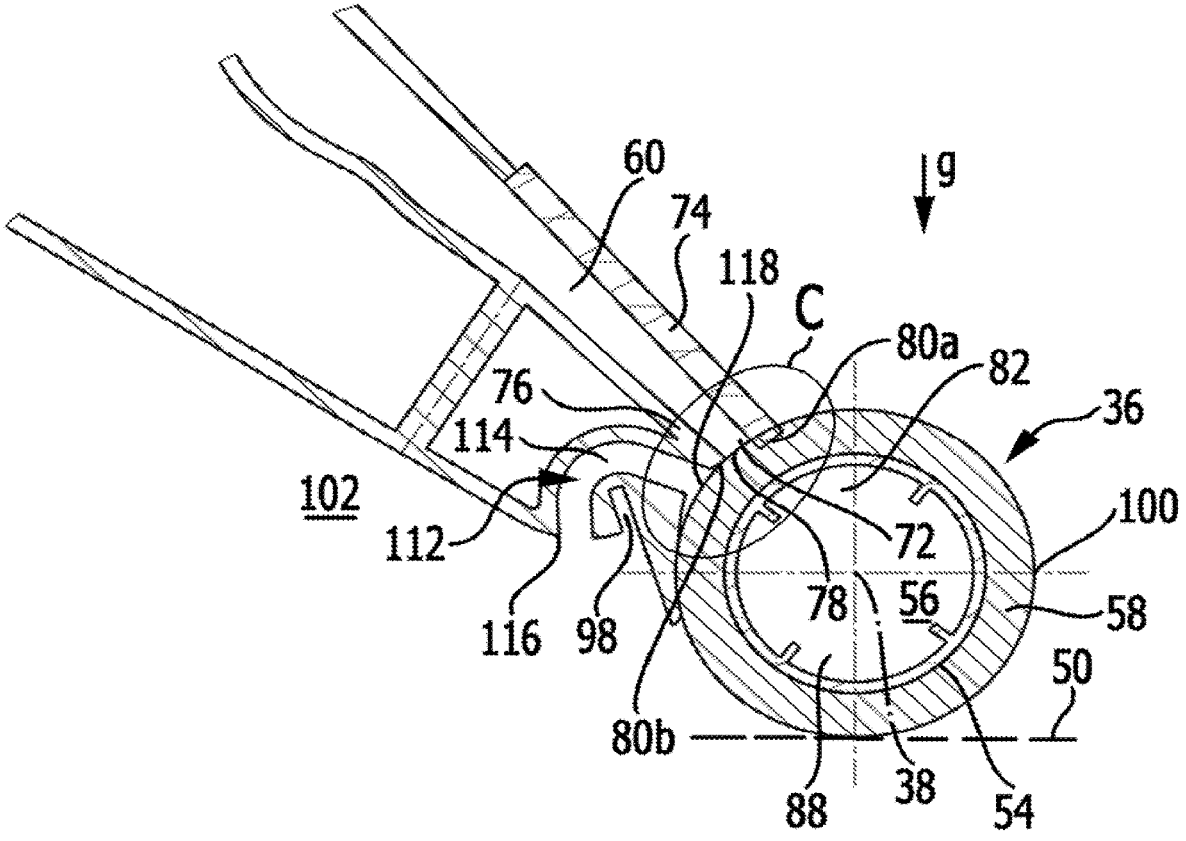
FIG. 9 is an enlarged representation of a portion of the cleaning roller in accordance with FIG. 4.

The cleaning roller 36 comprises a hollow roller 54 having an interior space 56 (refer to FIG. 9 for example). Located at the hollow roller 54 is a cleaning substrate 58 which is in particular made of a textile material.

In an exemplary embodiment, the cleaning roller 36 is wetted from the inside.

Cleaning liquid is supplied to the interior space 56 of the hollow roller 54 via the conduit 53. The hollow roller 54 is provided with corresponding openings directed towards the cleaning substrate 58. In this way, cleaning liquid can emerge and wet the cleaning substrate 58, thereby in turn enabling the cleaning liquid to be applied to the floor 50.

Further, by way of the hollow roller 54 including the interior space 56, the cleaning roller 36 can be placed and in particular slipped onto a rotationally driven shaft which is located at the support device 12. The cleaning roller 36 can be fixed to said shaft in rotationally fixed relationship thereto.

The suction channel device 42 comprises at least one suction channel 60 (cf. FIG. 9). Said suction channel 60 is arranged inside the suction channel device 42 and leads from the cleaning roller 36 to the fan device 40.

In an exemplary embodiment, the fan device 40 including the drive 44 is fixedly located at the support device 12 and in particular at the first frame bar 16. A drive 62 for the cleaning roller 36 is fixedly affixed to the second frame bar 18. In particular, the second frame bar 18 has arranged therein a gear for moment transfer to the shaft of the cleaning roller 36.

In this exemplary embodiment, the drive 62 and the fan device 40 including the drive motor 44 together form a unit which is fixedly located at the support device 12.

From the suction channel device 42, starting from an air side of the separator device 46, a pipe 64 leads from a connection 66 at the suction channel device 42 to a corresponding connection of the fan device 40. Located at the pipe 64 are pipe bends 68*a* and 68*b*. The pipe 64 and the pipe bends 68*a*, 68*b* are arranged exteriorly of the suction channel device 42 and the fan device 40. By way of example, they are arranged on a side that is opposite the drive 62.

In an exemplary embodiment, the suction channel device 42 is formed as a housing 70. Said housing 70 allows the at least one suction channel 60 to be arranged in a protected manner. Furthermore, the dirty liquid container 48 and the separator device 46 can be positioned inside the housing in a protected manner.

Figure 4:
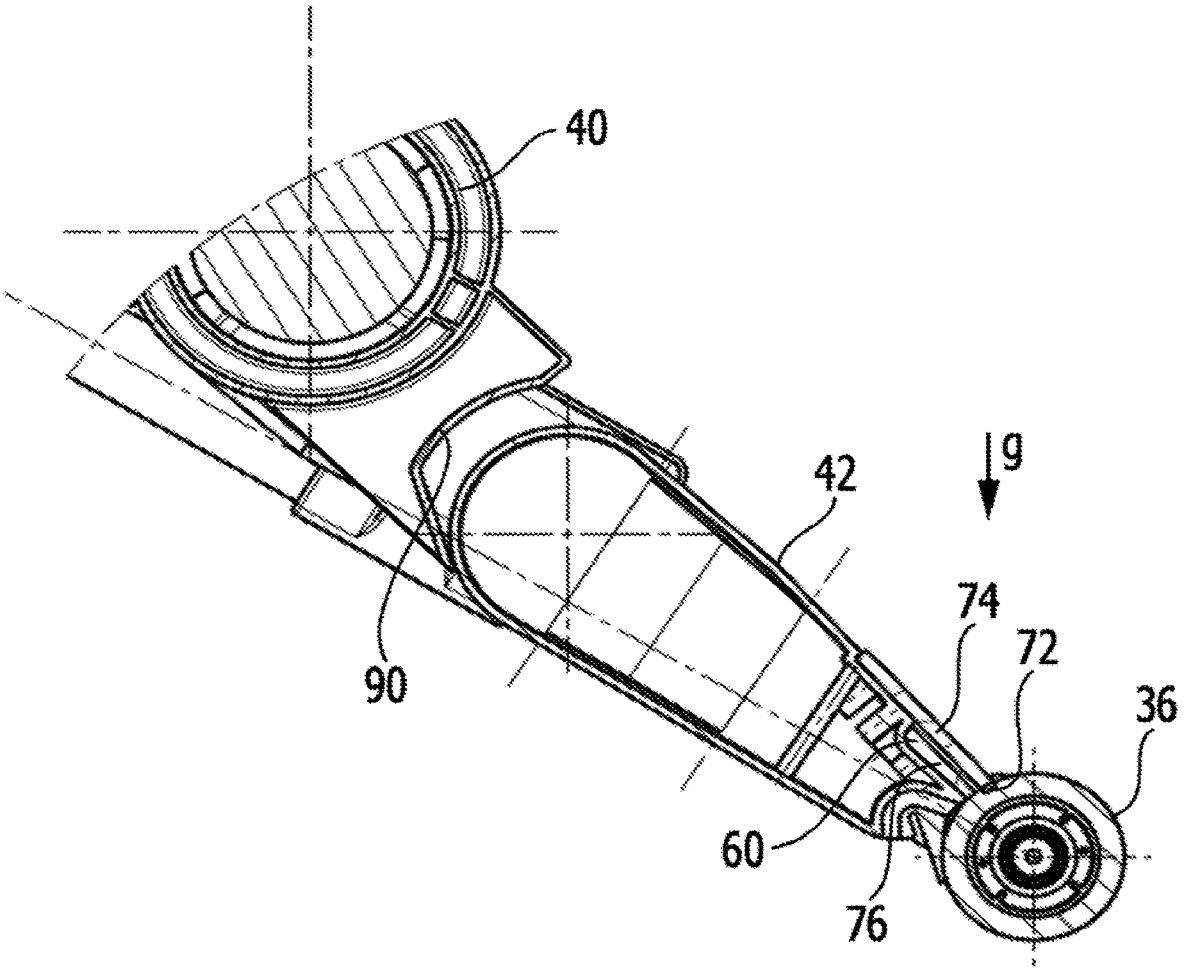
FIG. 4 is a sectional view in a plane parallel to the drawing plane of FIG. 3.

The suction channel 60 has a mouth 72 that is open towards the cleaning roller 36 (cf. FIGS. 4 and 9, for example). Via said mouth 72, the cleaning roller 36 is suctioned on an outer side thereof and the suction flow is coupled into the suction channel 60 and therefore into the suction channel device 42. The mouth 72 comprises a first mouth wall 74 and a second mouth wall 76. A mouth opening 78 is formed intermediate the first mouth wall 74 and the second mouth wall 76. The first mouth wall 74 is an upper mouth wall relative to the second mouth wall 76. When, for performing a cleaning operation, the cleaning roller 36 is placed on the floor 50 to be cleaned, then the first mouth wall 74 is located above the second mouth wall 76 with respect to the direction of gravity.

Spaced-apart transverse walls 75*a*, 75*b* are located between the first mouth wall 74 and the second mouth wall 76.

The first mouth wall 74 has an end face 80*a*. The second mouth wall has an end face 80*b* (cf. FIG. 9). The end faces 80*a* and 80*b* are at least approximately straight and parallel to each other. In particular, the end faces 80*a* and 80*b* are parallel to the axis of rotation 38.

The mouth opening 78 is rectangular in cross-section and extends preferably the entire length of the cleaning roller 36 which has a cleaning substrate 58 arranged thereon. A height of the mouth opening 78 (the distance between the first mouth wall 74 and the second mouth wall 76 at the mouth opening 78) is less than a diameter of the cleaning roller 36 and is for example no more than 10% of the diameter of the cleaning roller 36.

The mouth opening 78 is arranged in a fourth quadrant 82 relative to the cleaning roller 36 when the floor cleaning machine 10, in an operative operating mode thereof, is placed on the floor 50 and supported via the cleaning roller 36 and if, correspondingly, a coordinate plane is defined which has axes parallel and perpendicular to the floor 50 and where the center runs through the piercing point of the axis of rotation 38.

Figure 3:
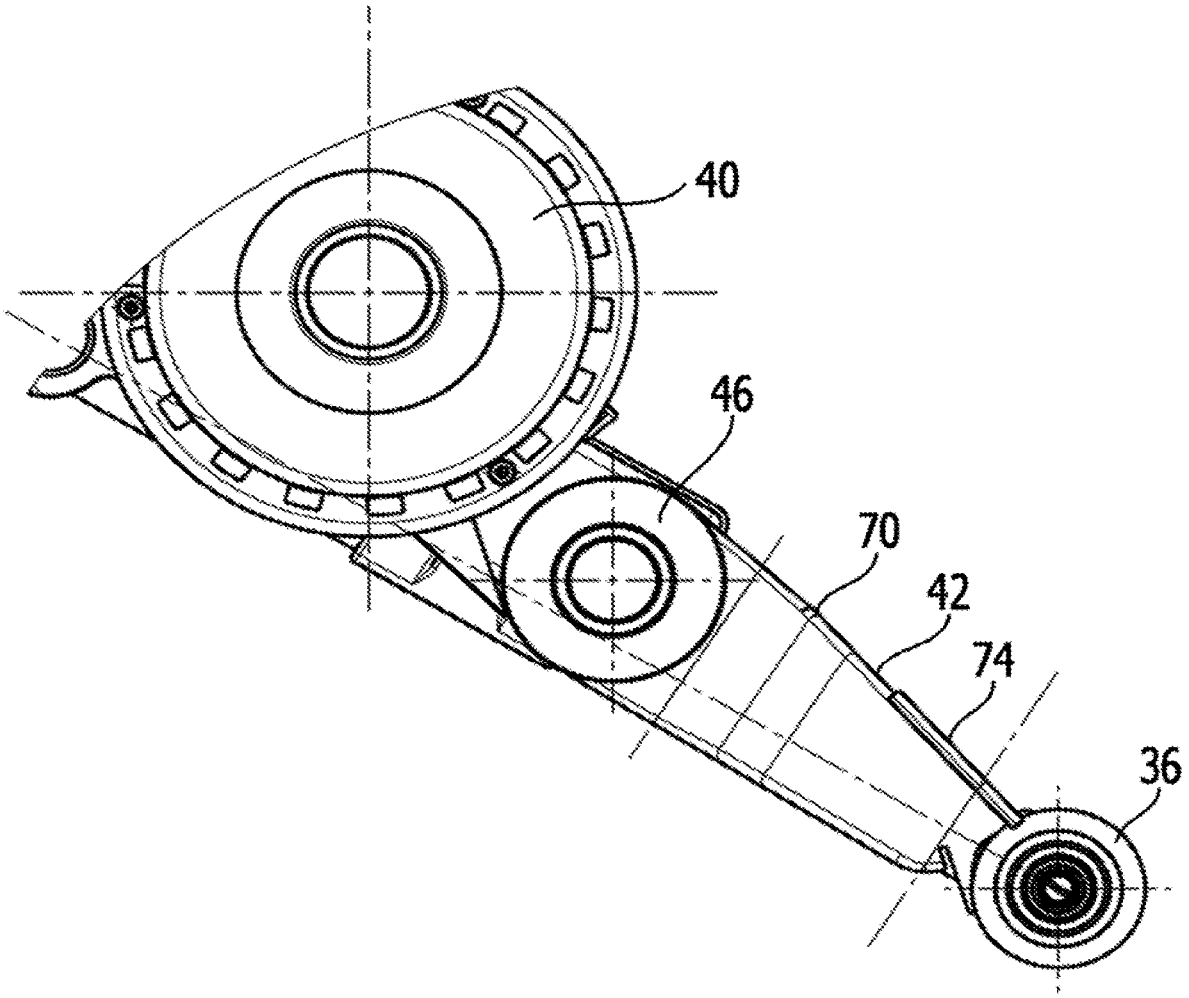
FIG. 3 is a partial side view of the floor cleaning machine in accordance with FIG. 1, in direction A.

The first mouth wall 74 is in contact against or protrudes into the cleaning substrate 58 of the cleaning roller 36. FIGS. 3 and 9 illustrate an exemplary embodiment in which the first mouth wall 74 protrudes into the cleaning substrate 58.

The end face 80*a* of the first mouth wall 74 is in contact against the cleaning substrate 58 or extends into the cleaning substrate 58 (FIGS. 4 and 9).

In the exemplary embodiment shown, the second mouth wall 76 is in contact against the cleaning substrate 58; the end face 80*b* thereof contacts the cleaning substrate 58 without protruding thereinto. Alternatively, it is in principle also possible for the mouth opening 78 to be, relative to the end face 80*b*, set back from to the cleaning roller 36 including the cleaning substrate 58, i.e. for the end face 80*b* to be spaced from the cleaning substrate 58, or for the end face 80*b* to protrude into the cleaning substrate 58.

The suction channel 60 leads from the mouth 72 to the connection 66.

Figure 14:
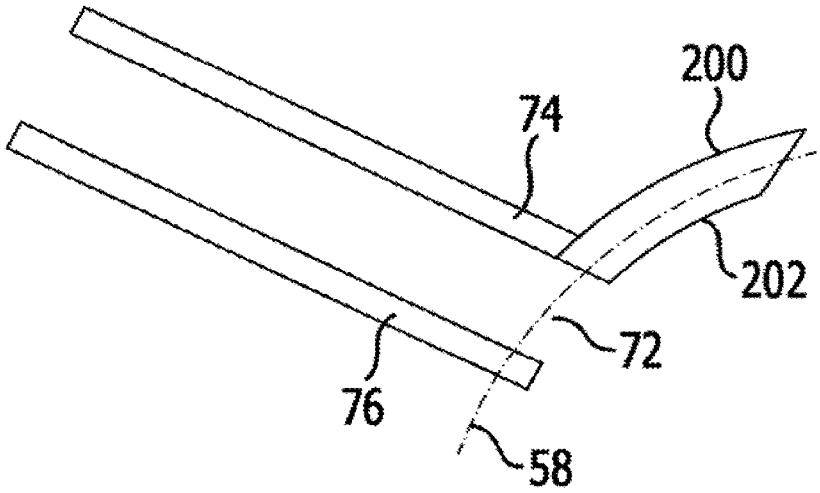
FIG. 14 is an enlarged representation of detail C of FIG. 9 in accordance with a variant of an exemplary embodiment.
Figure 15:
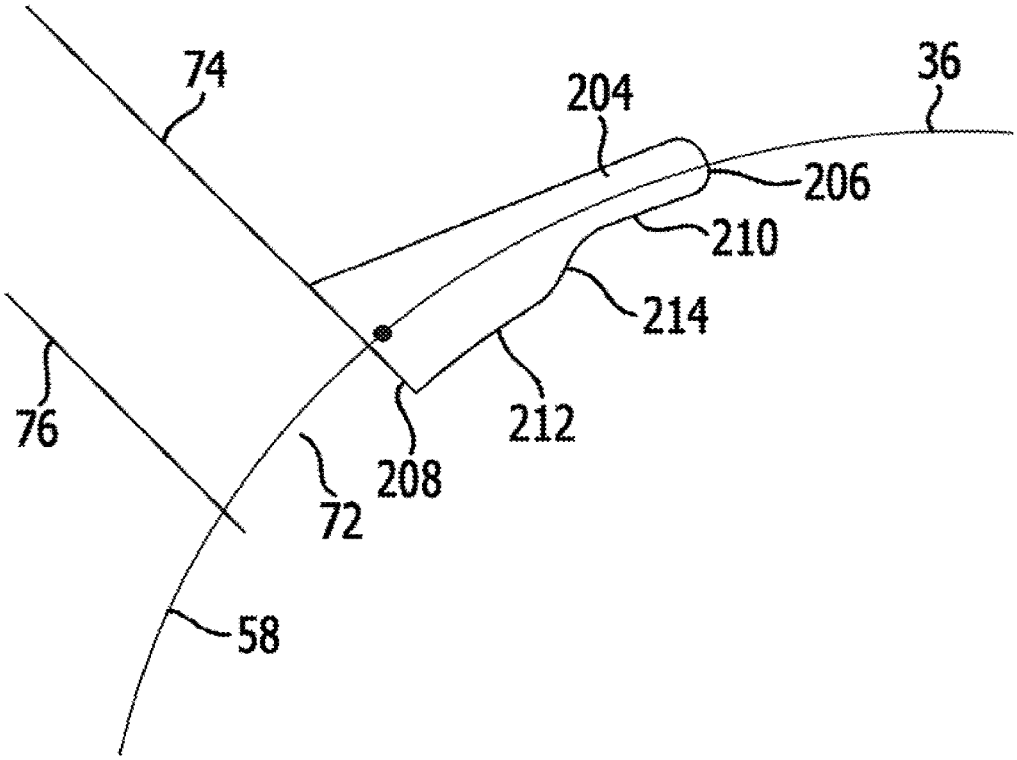
FIG. 15 is a representation similar to FIG. 14 in accordance with a further variant.

In an exemplary embodiment (FIGS. 14 to 16), a contact element 200 is arranged at the mouth 72. In an exemplary embodiment, said contact element 200 is arranged at the first mouth wall 74, wherein a fluid-tight relation is established between the first mouth wall 74 and the contact element 200. The contact element 200 faces transversely away from the first mouth wall 74.

The contact element 200 protrudes into the cleaning substrate 58 of the cleaning roller 36. It has its lower portion protruding into the cleaning substrate 58.

In the contact element 200, the area of protrusion thereof is a portion of the contact element 200.

A contour 202 of the contact element 200 is adapted to the cleaning roller 36. In particular, the contour 202, which is in facing relationship to the cleaning roller 36, is curved to the same curvature as the cleaning roller 36.

The contact element 200 provides enhanced coupling-in of fluid into the mouth 72.

In another exemplary embodiment (FIG. 15), a contact element 204 is provided that is located at the first mouth wall 74, in an orientation projecting transversely therefrom. Said contact element 204 has a first end 206 which is in spaced relation to the first mouth wall 74. It further has a second end 208 which is located at the mouth 72 and therefore at the mouth wall 74. The contact element 204 extends between the first end 206 and the second end 208.

The contact element 204 does not have a constant height (in cross-section) between the first end 206 and the second end 208. It has a first area 210 where the first end 206 is located. Said first area 210 transitions and in particular transitions continuously into a second area 212, wherein the second end 208 is located in the second area 212. An underside 214 of the contact element 204 has a larger distance from the axis of rotation 38 of the cleaning roller 36 at the first area 210 than at the second area 212.

In principle, there is a negative pressure present at the contact element 200 or 204. By forming the contact element 204 to have the first area 210 and the second area 212, the amount of negative pressure present in the area of the first end 206 is reduced when compared with the negative pressure in the area of the second end 208. This enhances the suction effect, in particular because the risk of liquid short-circuiting (pulling out liquid in the area of the first end 206) is reduced.

Advantageously, the contact element 200 or the contact element 204 has a length (between the first end 206 and the second end 208) that is larger than a corresponding opening length of the mouth 72.

Figure 16:
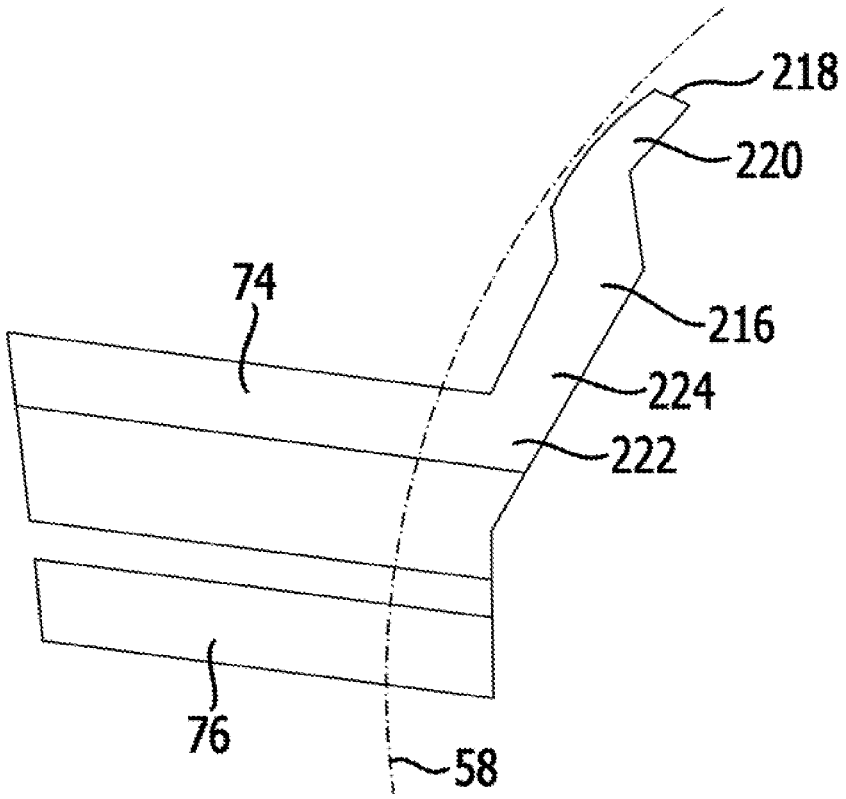
FIG. 16 is a representation similar to FIG. 14.

In a further exemplary embodiment, shown schematically in FIG. 16, a contact element 216 is arranged at the first mouth wall 74. The contact element 216 fully extends into the cleaning substrate 58 of the cleaning roller 36.

The contact element 216 has a first area 220 located at a first end 218 thereof; it has a second end 222 located at the first mouth wall 74, said second end 222 being formed in a second area 224. The contact element 216 has, on the side thereof facing towards the cleaning roller 36, a larger distance from the axis of rotation 38 in the first portion 220 than in the second portion 224.

In this exemplary embodiment, both the first portion 220 and the second portion 224 fully extend into the cleaning substrate 58.

The suction channel 60 tapers in an area towards the separator device 46. A kind of funnel 83 is thereby formed at the separator device 46 in order, on the one hand, to obtain effective suction over the entire length of the cleaning substrate of the cleaning roller 36 and, on the other hand, to increase the flow velocity for entry into the separator device.

In an exemplary embodiment, the cleaning roller 36 is driven for rotary motion in a direction of rotation 84. The rotation of the cleaning roller 36 and the operation of the fan device 40 are switched simultaneously by the switch 34. The corresponding drive 62 for driving the rotation of the cleaning roller 36 and the drive 44 have their drive energy supplied for example from a rechargeable battery device (not shown in the drawings), which is for example arranged in the housing 70 of the suction channel device 42, or from the mains grid.

The direction of rotation 84 is such that a line of contact 86 (FIG. 5(*a*)) made by the cleaning roller 36 with the floor 50 rotates away from the floor 50 in a direction towards the mouth 72. The direction of rotation 84 is such that the second mouth wall 76 is located upstream of the first mouth wall 74 with respect to said direction of rotation 84.

When the cleaning roller 36 is placed on the floor 50 during intended use, the direction of rotation 84 is clockwise from the perspective of a user standing up on the floor 50.

By the arrangement of the mouth 72 in the fourth quadrant 82, dirt that is picked up from the floor 50 is passed through the third quadrant 88 and delivered to the mouth 72 in the fourth quadrant 82.

In an alternative embodiment, the direction of rotation is counter to the direction of rotation 84, i.e. this rotation occurs in the counterclockwise direction. In this exemplary embodiment, the second mouth wall 76 is in contact against the cleaning substrate 58 or protrudes thereinto. The first mouth wall 74 can then be in contact against the cleaning substrate 58, it can be spaced therefrom or it can protrude thereinto. In this exemplary embodiment, dirt is picked up, the cleaning roller 36 then rotates from the second quadrant into the first quadrant and thence into the fourth quadrant, and the dirt is sucked in at the mouth 72.

In particular, a rotational velocity of the cleaning roller 36 is in the range between approximately 200 revolutions per minute and 400 revolutions per minute. The contact pressure weight exerted on the cleaning roller 36 is for example on the order of approximately 6 kg.

FIG. 5(*b*) schematically shows the course of a contact pressure force (down pressure force) for a cleaning roller 36 fitted with a textile cleaning substrate 58 depending on a rotational position thereof. The zero rotational angle refers to the line 86 as it is shown in FIG. 5(*a*). The line 86 contacts the floor 50 at zero rotational angle. That is the area where the highest contact pressure force exists. This causes a high level of line contact pressure; therefore, correspondingly, that is also the area where the highest concentration of water exists. Dirt on the floor 50 is correspondingly softened up. With further rotation of the cleaning roller 36, the contact pressure and hence the concentration of water decreases. The floor 50 can then be dried by the cleaning roller 36.

It is thereby possible for the cleaning roller 36 to be operated at a relatively low rotational velocity. Cleaning performance is enhanced and the level of residual moisture on the floor can be kept low. Even with a lack of cleaning liquid, the floor 50 is still treated gently, and therefore the risk of grinding into the floor is reduced.

The suction channel device 42 including the mouth 72 is urged against the cleaning roller 36 via an elastic device 90 (FIG. 6) and is thereby maintained in a biased condition. This is shown schematically in FIG. 6. On a first side 92, the elastic device 90 is supported on the support device 12; on a second side 94, it is supported on the separator device 46. In the corresponding exemplary embodiment, the separator device 46 and the suction channel device 42 form a single unit. The separator device 46 and the suction channel device 42 are connected together directly. As a result, the suction channel device 42 will be urged against the cleaning roller 36 by the elastic device 90, in supported relation to the support device 12.

Figure 6:
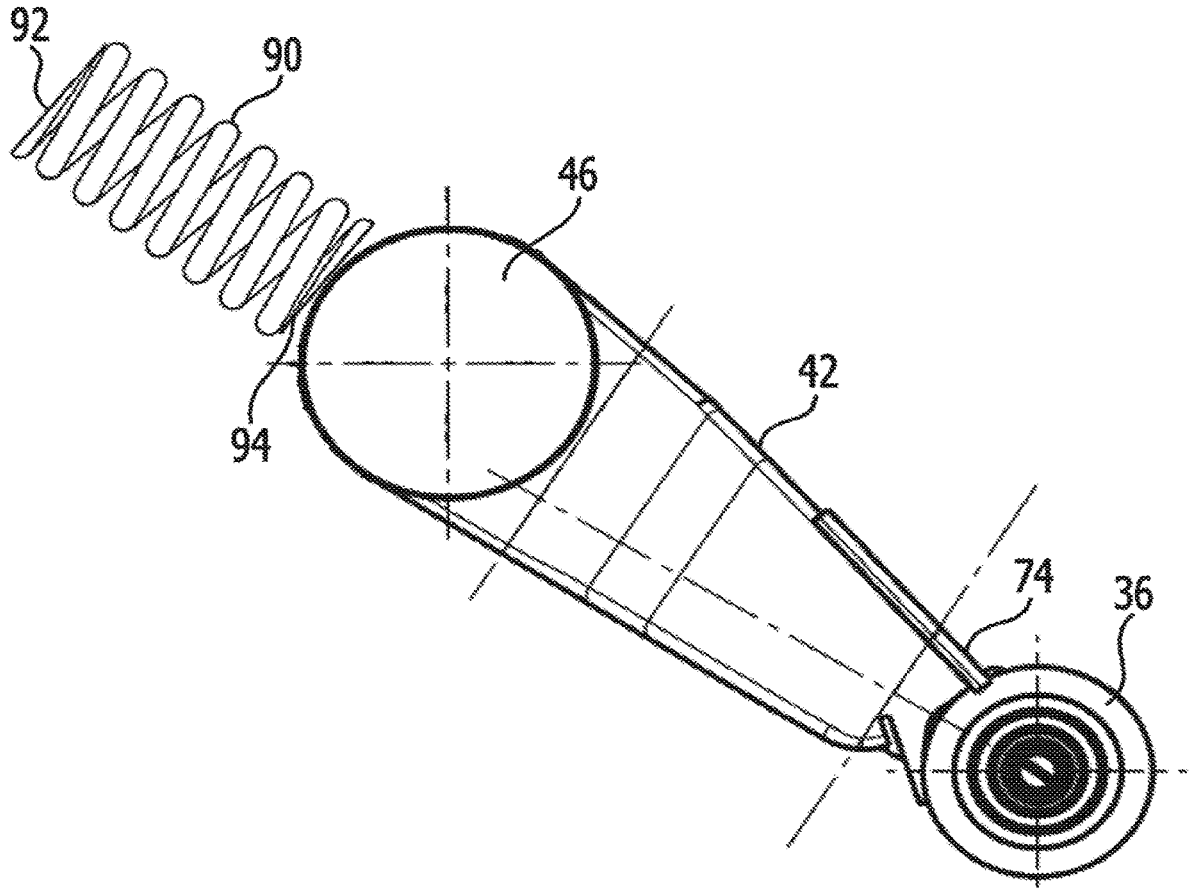
FIG. 6 is a schematic representation of a first exemplary embodiment of an elastic device.

This arrangement, as it is shown schematically in FIG. 6, corresponds to the arrangement used in the floor cleaning machine 10 in accordance with FIGS. 1 and 2.

The elastic device 90 is formed by a spring device comprising for example one or more coiled springs or bending springs. The corresponding elastic device 90 is supported on the fan device 40.

Figure 7:
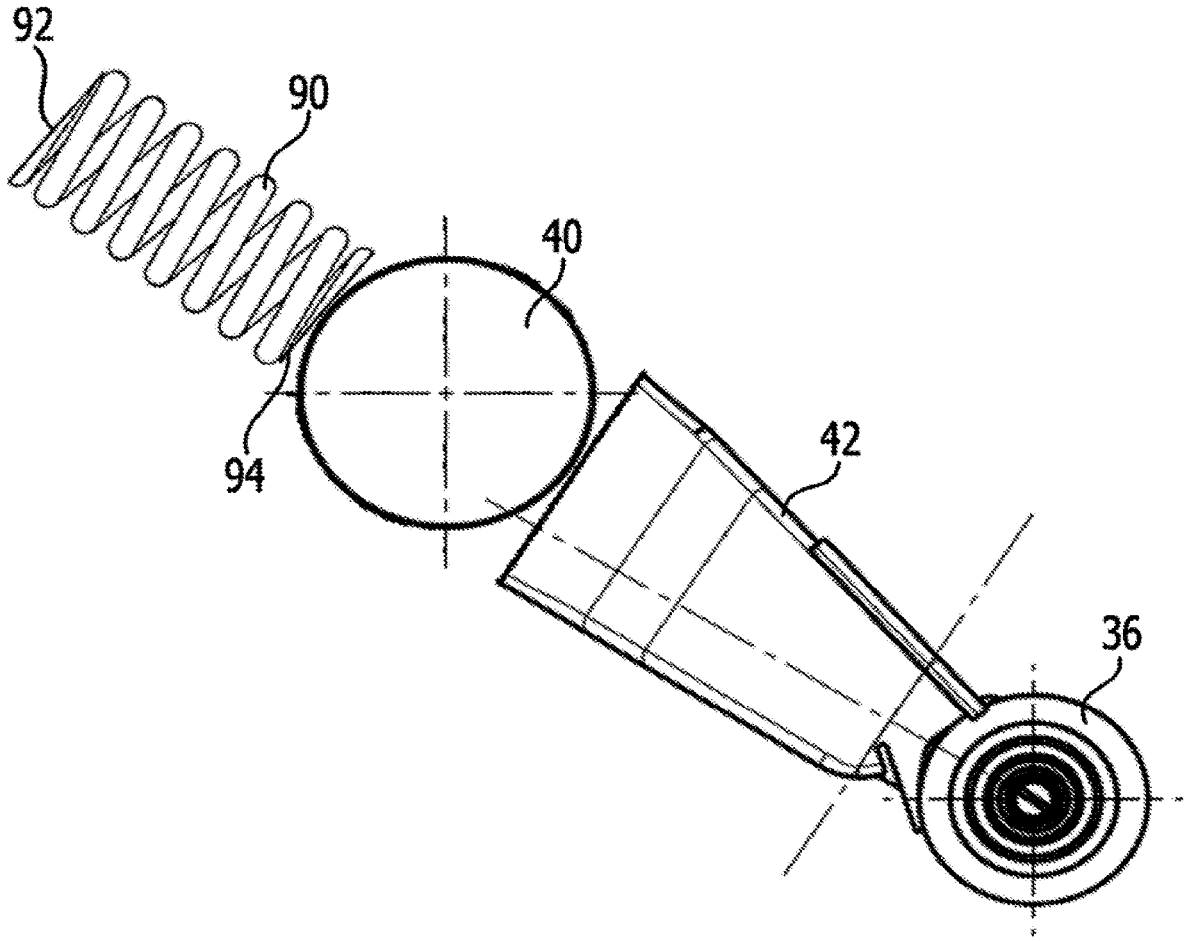
FIG. 7 is a schematic representation of a second exemplary embodiment of an elastic device.

In an alternative exemplary embodiment (FIG. 7), the separator device 46 and the suction channel device 42 are separate. The elastic device 90 comprising one or more springs is supported on the first side 92 thereof on the fan device 40. It has its second side 94 supported on the separator device 46 and urges the latter in a direction towards the cleaning roller 36 via a corresponding biasing force. The separator device 46 and the suction channel device 42 are connected together; however, this connection is not a direct connection but a force-locking connection. The separator device 46 thereby acts upon the suction channel device 42 with a corresponding contact pressure force and urges same against the cleaning roller 36.

Figure 8:
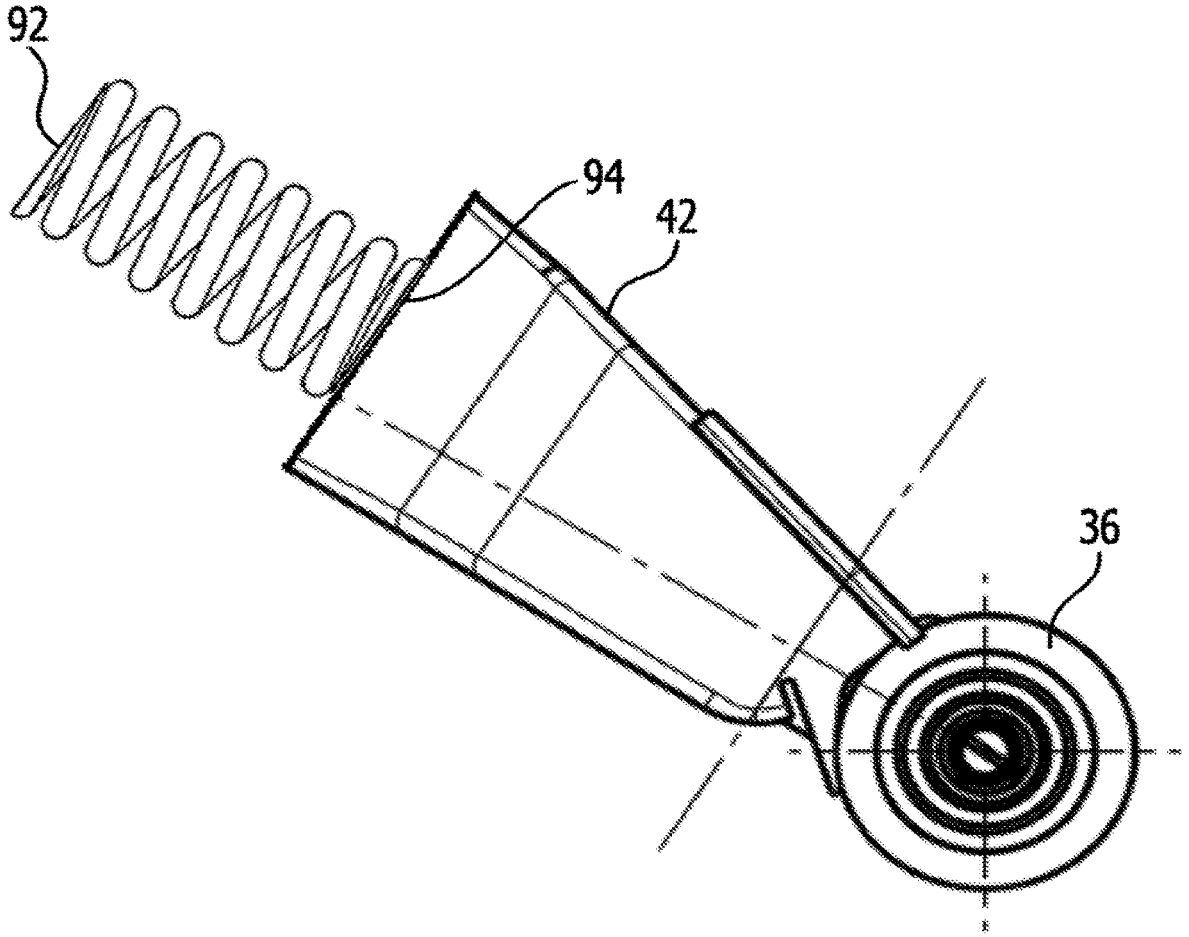
FIG. 8 is a schematic representation of a third exemplary embodiment of an elastic device.

In another embodiment (FIG. 8), the elastic device 90 has its first side 92 supported on the support device 12 (or the fan device 40 or the separator device 46); it has its second side 94 supported on the suction channel device 42 directly and urges the latter against the cleaning roller 36, in order to create the corresponding biasing force.

Figure 10:
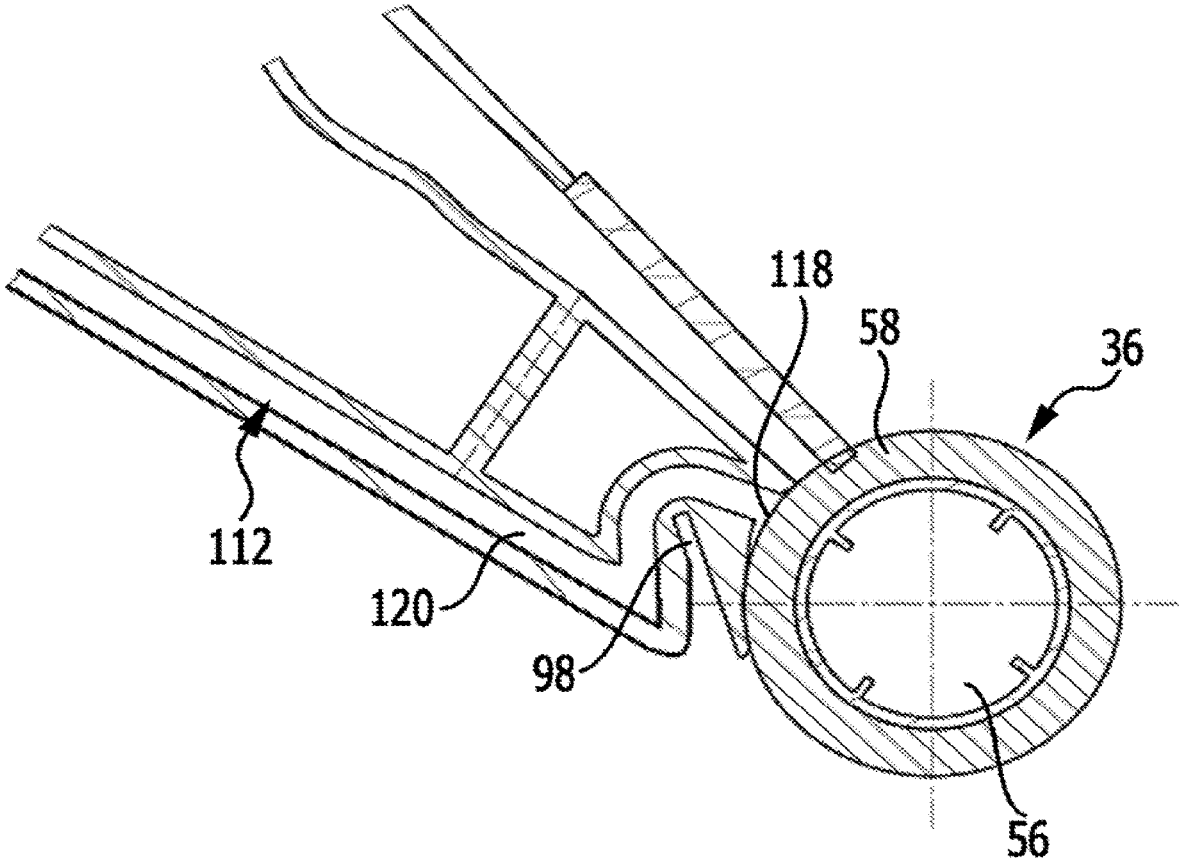
FIG. 10 is a variant of a floor cleaning machine, shown in a partial representation similar to FIG. 9.

In an exemplary embodiment (FIGS. 9 to 11 in particular), the cleaning roller 36 has (at least) one sweeping lip 96 associated with it. The sweeping lip 96 is located in a receptacle 98 (FIGS. 9 and 10, with sweeping lip not shown). The floor cleaning machine 10 has a front end 100 thereof located at the cleaning roller 36. The sweeping lip 96 is arranged behind the cleaning roller 36 with respect to said front end 100. It is fixed to an underside of the suction channel device 42.

The sweeping lip 96 closes off a space 102 between an underside 104 of the suction channel device 42 opposite the first mouth wall 74 and the floor 50 from the cleaning roller 36.

A normal mode of operation of the floor cleaning machine 10 is such that the latter is pushed, i.e. pushed forward. The corresponding direction is indicated in FIG. 1 by the arrow designated by the reference numeral 106. The sweeping lip 96 is configured such that it contacts the floor 50, thereby "sweeping up" coarse dirt. This coarse dirt, gathered up in a space 108 between the sweeping lip 96 and the cleaning roller 36, is picked up by the cleaning roller 36 rotating in its direction of rotation 84 and is delivered to the mouth 72, where it can be sucked in. By the provision of the sweeping lip 96, coarse dirt can also be sucked up.

Figure 11:
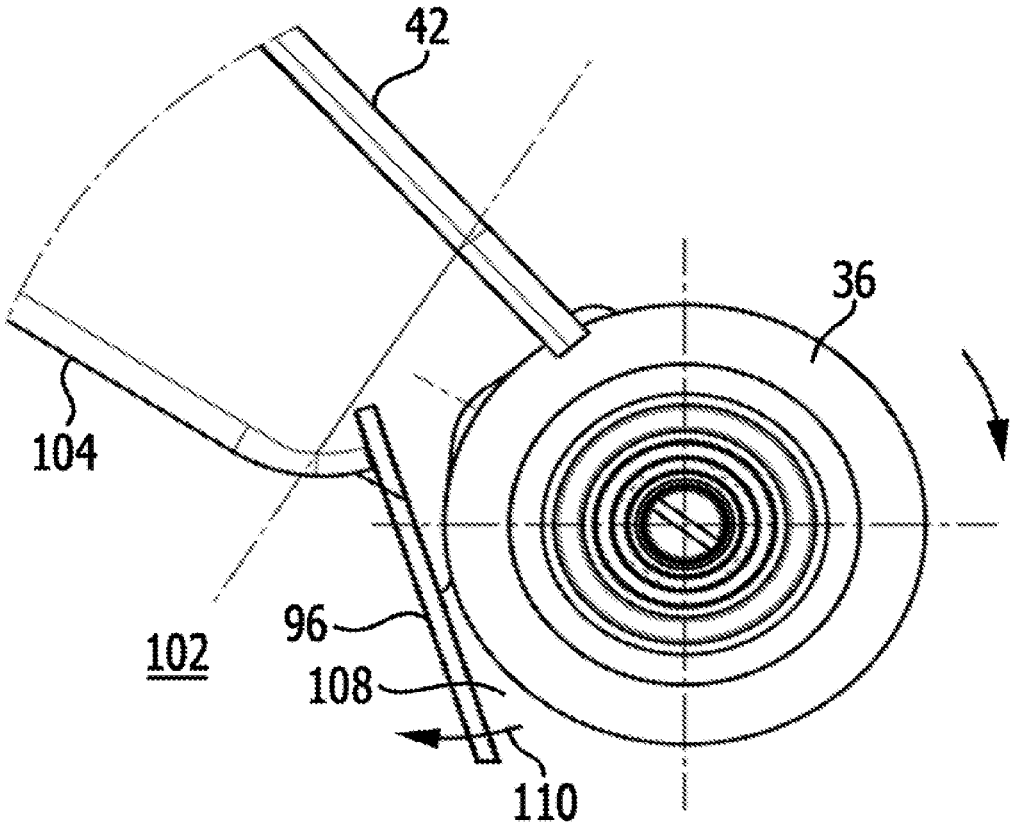
FIG. 11 is a view similar to FIG. 5(*a*) in accordance with a further exemplary embodiment.

In particular, the sweeping lip 96 is movably arranged and/or movably configured. This is indicated in FIG. 11 by the arrow designated by the reference symbol 110. For example, the movable configuration can be accomplished by a rubber formation with a correspondingly elastic rubber material. Alternatively or in addition, the sweeping lip 96 can be movably arranged, for example pivotally arranged, and can in particular be movably arranged on the suction channel device 42. By way of example, the sweeping lip 96 is then fabricated from a correspondingly hard rubber material.

In order to obtain an optimized suction action at the mouth 72 even when a sweeping lip 96 is present, the floor cleaning machine 10 comprises a supplementary air device 112 (refer to FIGS. 9 and 10). By way of the supplementary air device 112, the cleaning roller 36 has supplementary air supplied to it at or near the mouth 72 in order to provide optimized suction.

In an exemplary embodiment (FIG. 9), the supplementary air device comprises (at least) one channel 114 which is arranged in the suction channel device 42. Said channel 114 has an inlet-side mouth 116 for coupling in supplementary air and an outlet-side mouth 118 for coupling out supplementary air that has been coupled in through the inlet-side mouth 116.

The inlet-side mouth 116 is arranged at the underside 104 of the suction channel device 42 in spaced relation to the cleaning roller 36. The outlet-side mouth 118 faces towards the cleaning roller 36. The outlet-side mouth 118 is arranged upstream of the mouth 72 with respect to the direction of rotation 84.

In particular, the outlet-side mouth 118 is arranged in the fourth quadrant 82. It is located in the vicinity of the mouth 72.

In an exemplary embodiment, the end face 80*b* of the second mouth wall 76 also forms an end face of a wall in which a mouth opening of the outlet-side mouth 118 is located.

Supplementary air can then be coupled in from the space 102 and can be supplied to the cleaning roller 36.

In a further exemplary embodiment (FIG. 10), the supplementary air device 112 comprises (at least) one channel 120 which has, at an inlet side thereof, a corresponding mouth thereof (not shown in FIG. 10) coupled to the fan device 40. By way of example, cooling air or exhaust air from the fan device 40 is used as supplementary air and this is then conveyed from the fan device 40 through the channel 120 to the cleaning roller 36. In particular, the channel 120 then extends along the suction channel device 42.

Here, an outlet-side mouth 118 is, in principle, arranged in the same manner as described above in conjunction with the exemplary embodiment in accordance with FIG. 9.

Figure 12:
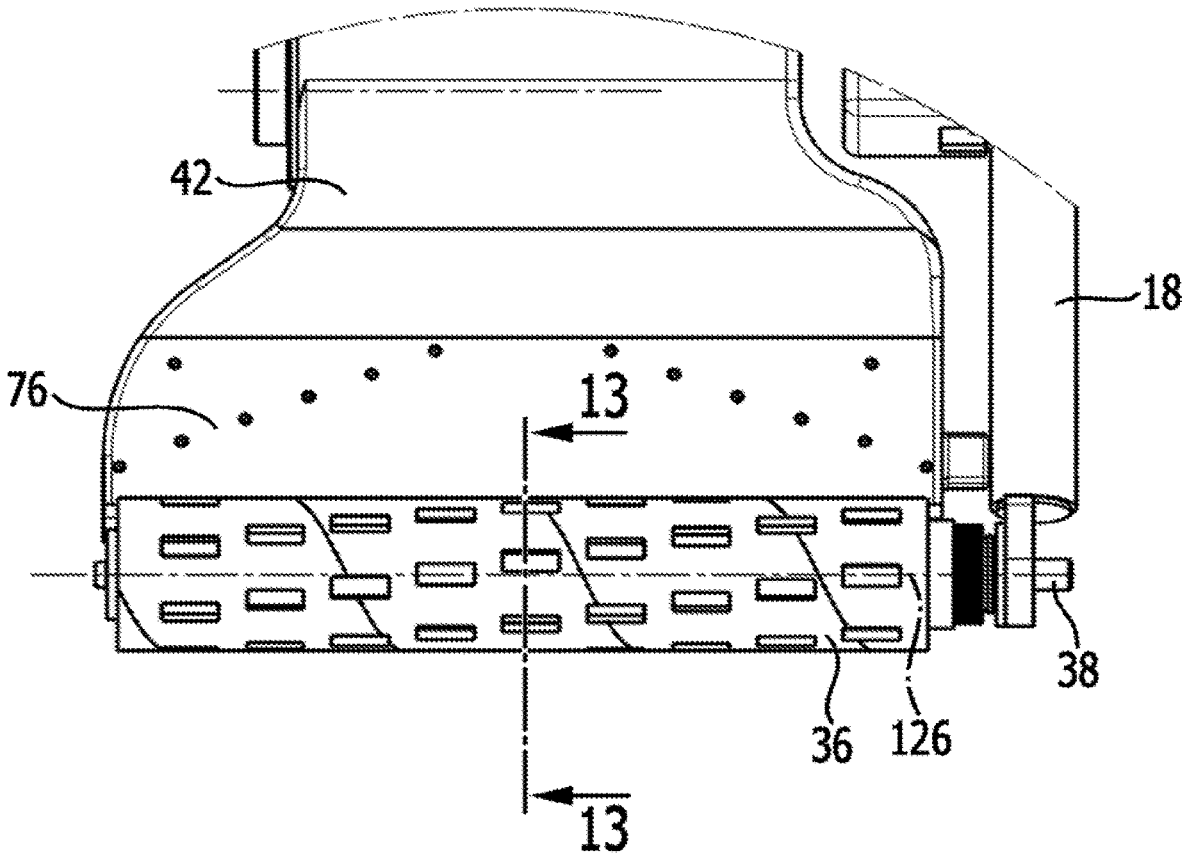
FIG. 12 is a top view of a part of the floor cleaning machine in accordance with FIG. 1, in direction B.
Figure 13:
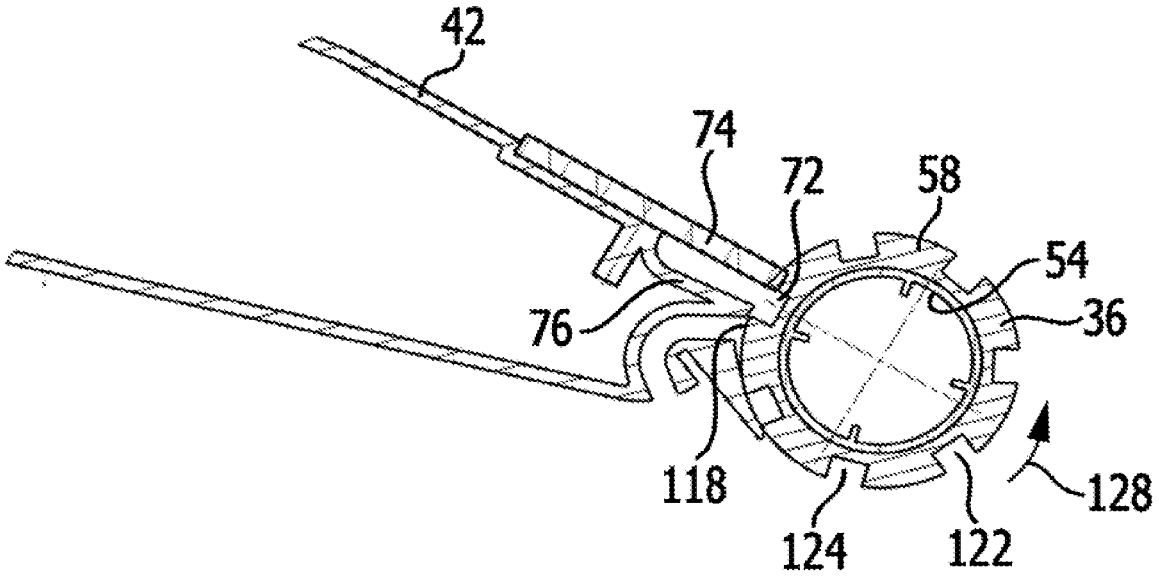
FIG. 13 is a sectional view taken along line 13-13 of FIG. 12.

In an exemplary embodiment (FIGS. 12 and 13), the cleaning roller 36 is provided with grooves 122. Such a groove is formed in the cleaning substrate 58. For example, a groove 122 is formed by it being a recess in the cleaning substrate 58 that is left with no cleaning substrate 58 on it or that is left with a height of the cleaning substrate 58 above the hollow roller 54 which is less than that presented exteriorly of the corresponding groove 122.

In the exemplary embodiment, the groove is illustrated as being rectangular in cross-section. The corresponding groove formed as a recess in the cleaning substrate 58 can also have a different shape. It may have a circular cross-section for example or have a still different cross-sectional shape.

Such a groove 122 then comprises a space 124.

The cleaning roller 36 comprises a plurality of grooves 122 which are spaced apart in an axial direction 126 (which is parallel to the axis of rotation 38) and are spaced apart in a circumferential direction 128.

The cleaning roller 36 is patterned by the grooves 122. Upon rotation of the cleaning roller 36, a short pulse of air is generated at the individual grooves 122 in each case as they pass through the suction flow at the mouth 72. Said pulse of air is able to entrain dirt particles that have become entangled in the cleaning substrate 58.

In particular, the grooves 122 are uniformly distributed on the cleaning roller 36 with respect to the circumferential direction 128 and the axial direction 126 in order to prevent, as much as possible, dead spots with respect to dirt entrainment.

For example, for a groove 122 having a rectangular cross-section, a length of the groove 122 in the axial direction 126 is no more than 10% of the length of the cleaning roller 36 with its cleaning substrate 58 in said axial direction 126.

Furthermore, for a groove 122 having a rectangular cross-section, it is advantageous for a width of the groove 122 in the circumferential direction 128 to be no more than 5% of a total circumferential dimension of the cleaning roller 36 at a surface of the cleaning substrate 58.

In operation, the floor cleaning machine 10 is supported on the cleaning roller 36 alone. In particular, the floor cleaning machine 10 is configured in a manner that is free of supporting wheels. This prevents the problem of abrasion marking that would be presented by supporting wheels.

The floor cleaning machine 10 works as follows:

For performing a cleaning operation, the floor cleaning machine 10 is operated such that rotation of the cleaning roller 36 in the direction of rotation 84 is driven by a corresponding drive. The fan device 40 provides for a corresponding negative pressure to be applied in order to provide a suction flow.

The cleaning roller 36 is wetted from the inside with cleaning liquid from the cleaning liquid container 52, whereby the cleaning substrate 58 is wetted. The cleaning roller 36 is suctioned at an outer side thereof, at the mouth 72, through the suction channel device 42.

The rotational velocity of the cleaning roller 36 is adjusted such that water droplets are largely prevented from flying off the cleaning roller 36.

The direction of rotation 84 preferably points towards a user when holding the floor cleaning machine 10 by the user holding unit. Normal operation, in which a user works his or her way out of the space being cleaned, can thereby be performed in an effective manner.

The suction channel device 42 including the mouth 72 is urged against the cleaning roller 36 by the elastic device 90, and in particular by spring force, in such a manner that an effective suction action is realized. In particular, the first mouth wall 74 is in contact against or penetrates into the cleaning substrate 58.

The sweeping lip 96 provides a sweeping function for particles that are not picked up directly by the cleaning roller 36. The cleaning roller 36 is a wiping roller. The sweeping lip 96 acts to ensure that coarse dirt also gets picked up by the cleaning roller 36 and is thereby delivered to the mouth 72.

In principle, a contact of the sweeping lip 96 against the floor 50 to be cleaned hinders air flow to the mouth 72. A sufficient supply of air is ensured by the provision of the supplementary air device 112. This then allows air taken from the surroundings to be supplied or process exhaust air or exhaust air from the fan device to be supplied. This in turn enables good coarse dirt pick-up at acceptable residual moisture levels.

The cleaning roller 36 is in contact against the floor 50. The contact pressure force is highest at a line of contact, and that is where the highest amount of cleaning liquid is provided which, in turn, can soften up dirt on the floor 50. Outside the line of contact 86, the contact pressure force is correspondingly lower and the concentration of cleaning liquid is then also at a lower level. The floor 50 can then be dried by the cleaning roller 36.

During a cleaning operation, the machine's entire weight is supported by the cleaning roller 36.

The cleaning roller 36 is patterned by the grooves 122. This causes short pulses of air to be generated during passage through the suction flow at the mouth 72 in order to enable entrainment of dirt particles that have become entangled in the cleaning substrate 58.

REFERENCE SYMBOL LIST

10 floor cleaning machine
12 support device
14 frame
16 first frame bar
18 second frame bar
20 element
22 joint
24 stick device
26 pivot axis
28 handle
30 loop
32 grip element
34 switch
36 cleaning roller
38 axis of rotation
40 fan device
42 suction channel device
44 drive
46 separator device
48 dirty liquid container
50 floor
52 cleaning liquid container
54 hollow roller
56 interior space
58 cleaning substrate
60 suction channel
62 drive
64 pipe
66 connection
68*a* pipe bend
68*b* pipe bend
70 housing
72 mouth
74 first mouth wall
75*a* transverse wall
75*b* transverse wall
76 second mouth wall
78 mouth opening
80*a* end face
80*b* end face
82 fourth quadrant
83 funnel
84 direction of rotation
86 line of contact
88 third quadrant
90 elastic device
92 first side
94 second side
96 sweeping lip
98 receptacle
100 front end
102 space
104 underside
106 arrow
108 space
110 arrow
112 supplementary air device
114 channel
116 inlet-side mouth
118 outlet-side mouth
120 channel
122 groove
124 space
126 axial direction
128 circumferential direction
200 contact element
202 contour
204 contact element
206 first end
208 second end
210 first area
212 second area
214 underside
216 contact element
218 first end
220 first area
222 second end
224 second area

The invention claimed is:

1. A floor cleaning machine, comprising:

a support device;

at least one cleaning roller which is arranged on the support device, is capable of being driven in rotation and is provided with a cleaning substrate, said cleaning substrate being made of a textile material; and at least one mouth towards the at least one cleaning roller;

wherein the at least one mouth comprises a first mouth wall and a spaced second mouth wall having a mouth opening formed therebetween, wherein the first mouth wall is positioned above the second mouth wall relative to the direction of gravity when the at least one cleaning roller is placed on a floor that is to be cleaned;

wherein at least one of the first mouth wall and the second mouth wall protrudes into the cleaning substrate of the at least one cleaning roller.

2. The floor cleaning machine in accordance with claim 1, wherein at least one of an end face of the first mouth wall and an end face of the second mouth wall is at least approximately parallel to an axis of rotation of the at least one cleaning roller.

3. The floor cleaning machine in accordance with claim 1, wherein the first mouth wall is in contact against the cleaning substrate or protrudes thereinto and the second mouth wall is in contact against the cleaning substrate of the at least one cleaning roller or is spaced therefrom or protrudes thereinto, or wherein the second mouth wall is in contact against the cleaning substrate or protrudes thereinto and the first mouth wall is in contact against the cleaning substrate or protrudes thereinto or is spaced therefrom.

4. The floor cleaning machine in accordance with claim 1, wherein the mouth has arranged thereat a contact element which is in contact against or protrudes into the cleaning substrate and projects transversely away from the first mouth wall or the second mouth wall, wherein a fluid seal is present between the contact element and the corresponding mouth wall.

5. The floor cleaning machine in accordance with claim 4, wherein the contact element is located at the first mouth wall.

6. The floor cleaning machine in accordance with claim 4, wherein the contact element has, on a side thereof facing towards the at least one cleaning roller, a curved contour which is adapted to the at least one cleaning roller.

7. The floor cleaning machine in accordance with claim 4, wherein the contact element has a first end which is spaced from the mouth and has a second end which is positioned at the mouth and wherein the contact element is configured such that a resultant negative pressure is less at the first end than at the second end.

8. The floor cleaning machine in accordance with claim 7, wherein the contact element has a first area comprising the first end and has a second area comprising the second end, wherein a distance of the contact element from an axis of rotation of the at least one cleaning roller is larger at the first area than at the second area.

9. The floor cleaning machine in accordance with claim 1, wherein the second mouth wall is arranged upstream of the first mouth wall with respect to a direction of rotation of the at least one cleaning roller.

10. The floor cleaning machine in accordance with claim 1, wherein a distance of an end face of the first mouth wall from an axis of rotation of the at least one cleaning roller is less than a distance of an end face of the second mouth wall from said axis of rotation.

11. The floor cleaning machine in accordance with claim 1, wherein the mouth opening of the at least one mouth is at least approximately rectangular in cross-section.

12. The floor cleaning machine in accordance with claim 1, wherein at least one cleaning liquid container is provided which is operatively connected for fluid communication with the at least one cleaning roller.

13. The floor cleaning machine in accordance with claim 12, wherein the at least one cleaning liquid container is arranged on a user holding unit.

14. The floor cleaning machine in accordance with claim 1, wherein a dirty liquid container is provided, said dirty liquid container being associated with a separator device.

15. The floor cleaning machine in accordance with claim 1, wherein the support device has arranged thereon a user holding unit.

16. The floor cleaning machine in accordance with claim 15, wherein a pivot axis of the joint is oriented parallel to an axis of rotation of the at least one cleaning roller.

17. The floor cleaning machine in accordance with claim 15, wherein the user holding unit comprises a stick device, said stick device having a handle located thereon.

18. The floor cleaning machine in accordance with claim 1, wherein, in a cleaning process, the floor cleaning machine is supported on the floor via the at least one cleaning roller alone.

19. The floor cleaning machine in accordance with claim 1, wherein a direction of rotation of the at least one cleaning roller is from a line of contact with the floor to be cleaned towards the second mouth wall and then towards the first mouth wall.

20. The floor cleaning machine in accordance with claim 1, wherein at least one sweeping lip is associated with the at least one cleaning roller.

* * * * *